US011591883B2

(12) United States Patent
Dyck et al.

(10) Patent No.: US 11,591,883 B2
(45) Date of Patent: Feb. 28, 2023

(54) TUBING DRAIN WITH BURST INNER BODY

(71) Applicant: PLAINSMAN MFG. INC., Edmonton (CA)

(72) Inventors: Tyler Jarret Dyck, Edmonton (CA); Mark Andrew Lea-Wilson, Edmonton (CA); Shane Tyler McAssey, Ardrossan (CA)

(73) Assignee: Plainsman Mfg. Inc., Edmonton (CA)

( * ) Notice: Subject to any disclaimer, the term of this patent is extended or adjusted under 35 U.S.C. 154(b) by 126 days.

(21) Appl. No.: 17/111,412

(22) Filed: Dec. 3, 2020

(65) Prior Publication Data

US 2022/0145723 A1 May 12, 2022

(30) Foreign Application Priority Data

Nov. 12, 2020 (CA) ..... CA 3098850

(51) Int. Cl.
*E21B 34/06* (2006.01)
*E21B 34/08* (2006.01)
*E21B 17/042* (2006.01)

(52) U.S. Cl.
CPC ..... *E21B 34/063* (2013.01); *E21B 34/08* (2013.01); *E21B 17/042* (2013.01)

(58) Field of Classification Search
CPC ..... E21B 34/063; E21B 34/08
See application file for complete search history.

(56) References Cited

U.S. PATENT DOCUMENTS

| | | | |
|---|---|---|---|
| 1,814,800 | A | 7/1931 | Heeter |
| 3,055,424 | A | 9/1962 | Allen |
| 3,429,384 | A | 2/1969 | Shore |
| 3,981,360 | A | 9/1976 | Marathe |
| 4,166,715 | A | 9/1979 | Huckaby |
| 4,304,422 | A | 12/1981 | Schwarz |
| 4,637,471 | A | 1/1987 | Soderberg |
| 4,773,299 | A | 9/1988 | Oestreich et al. |
| 5,355,908 | A | 10/1994 | Berger |
| 5,372,197 | A | 12/1994 | Wacker |
| 5,782,303 | A | 7/1998 | Christian |
| 6,095,247 | A | 8/2000 | Streich et al. |
| 6,497,285 | B2 | 12/2002 | Walker |
| 6,591,915 | B2 | 7/2003 | Burris et al. |

(Continued)

FOREIGN PATENT DOCUMENTS

| | | |
|---|---|---|
| CA | 2493267 | 3/2004 |
| CN | 101148977 | 3/2008 |

(Continued)

*Primary Examiner* — David Carroll
(74) *Attorney, Agent, or Firm* — Colby Nipper PLLC

(57) ABSTRACT

A tubing drain with a reusable body and a replaceable sacrificial burst element, the tubing drain comprising an annular body with a window and first and second connector ends, each connector end connectable to an end of tubing sections in a tubing string. The tubing drain also has an inner body insertable into the annular body, the inner body providing the replaceable sacrificial burst element. A burst profile in the inner body aligns with the window in the annular body and provides a burst element which may be configured to burst when a target pressure differential occurs across the burst profile, thereby draining fluids from the tubing string into the casing string.

21 Claims, 18 Drawing Sheets

(56) References Cited

U.S. PATENT DOCUMENTS

| | | | | |
|---|---|---|---|---|
| 6,752,212 | B2 | 6/2004 | Burris et al. | |
| 7,028,778 | B2 | 4/2006 | Krywitsky | |
| 7,267,178 | B2 | 9/2007 | Krywitsky | |
| 7,413,012 | B2 | 8/2008 | Davila | |
| 7,686,078 | B2 | 3/2010 | Khomynets | |
| 7,950,409 | B2 * | 5/2011 | Stokes | E21B 34/063 137/68.21 |
| 8,833,448 | B2 | 9/2014 | Krywitsky | |
| 9,784,069 | B1 | 10/2017 | Bair et al. | |
| 2001/0022225 | A1 * | 9/2001 | Burris | E21B 34/063 166/317 |
| 2002/0108750 | A1 | 8/2002 | Hinrichs | |
| 2004/0118566 | A1 * | 6/2004 | Krywitsky | E21B 29/08 166/317 |
| 2011/0259582 | A1 * | 10/2011 | Krywitsky | G01M 3/2815 166/321 |
| 2015/0083421 | A1 * | 3/2015 | Sommers | E21B 43/261 166/373 |
| 2015/0240591 | A1 * | 8/2015 | Saltel | E21B 43/26 166/308.1 |
| 2017/0114598 | A1 * | 4/2017 | Klotz | E21B 34/063 |
| 2019/0040695 | A1 | 2/2019 | Sim | |

FOREIGN PATENT DOCUMENTS

| | | |
|---|---|---|
| CN | 201843584 | 5/2011 |
| CN | 202132652 | 2/2012 |
| CN | 202220585 | 5/2012 |
| CN | 202510088 | 10/2012 |
| CN | 203230386 | 10/2013 |
| CN | 203373425 | 1/2014 |
| CN | 204024503 | 12/2014 |
| CN | 105317401 | 2/2016 |
| CN | 109538162 | 3/2019 |
| EP | 1021638 | 7/2000 |
| WO | 2004025160 | 3/2004 |
| WO | 2018098595 | 6/2018 |

* cited by examiner

Fig. 1C
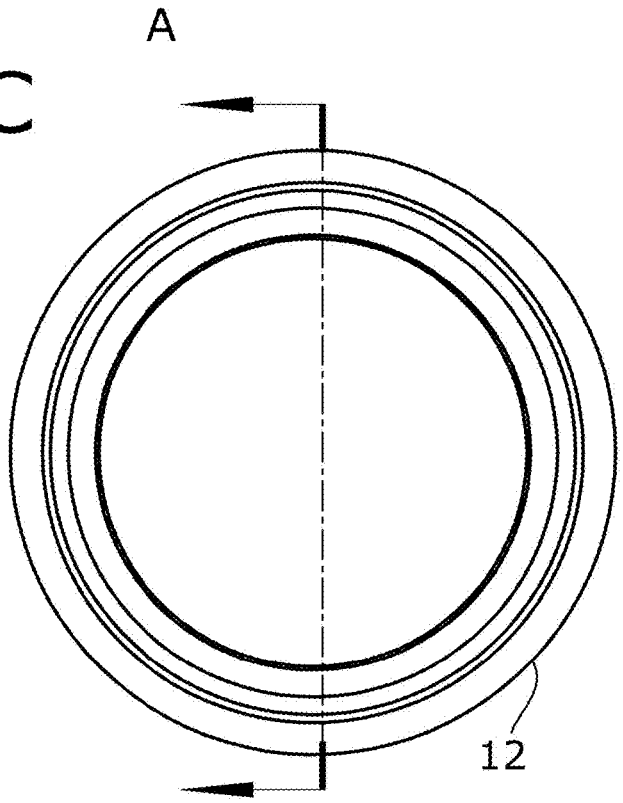
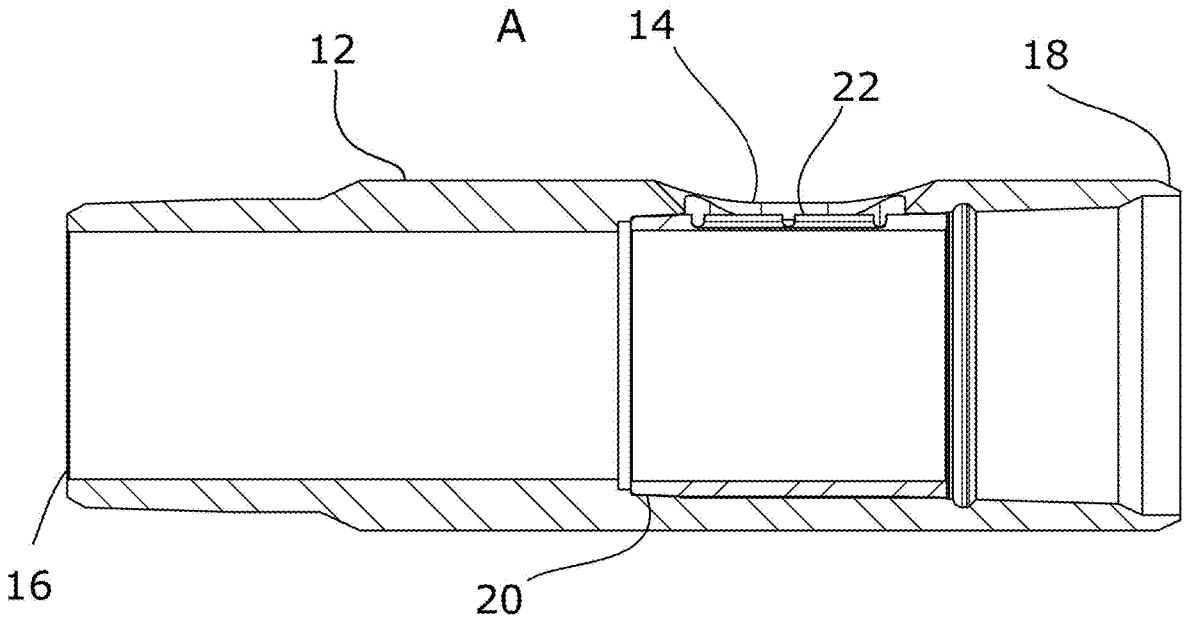
Fig. 1D

Fig. 2A
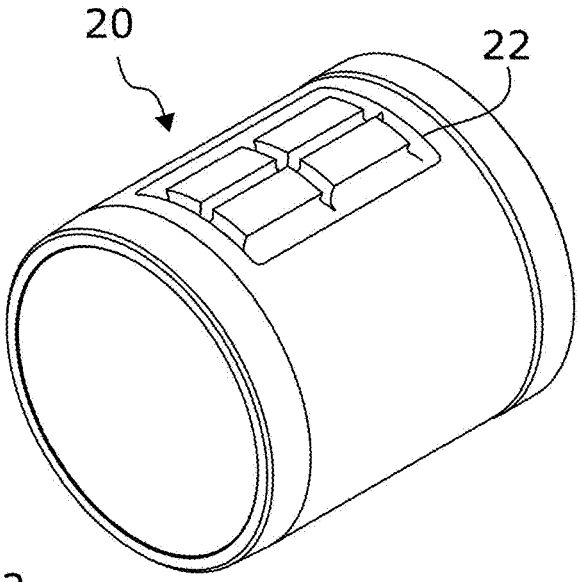
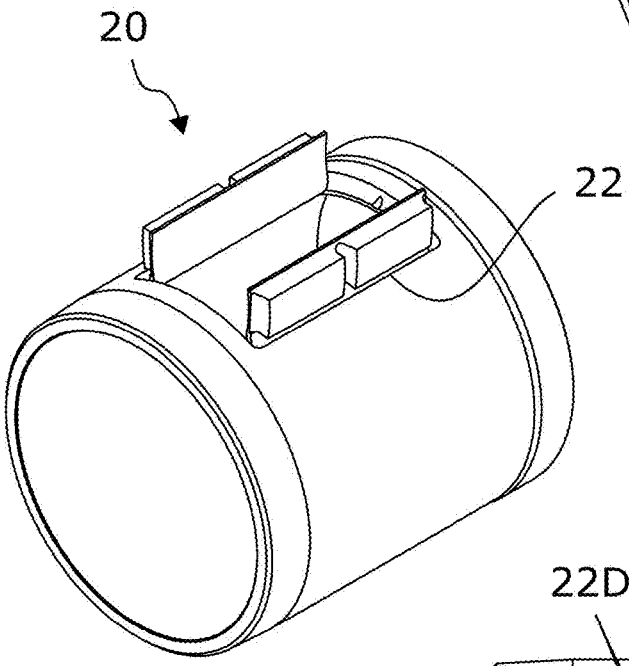
Fig. 2B
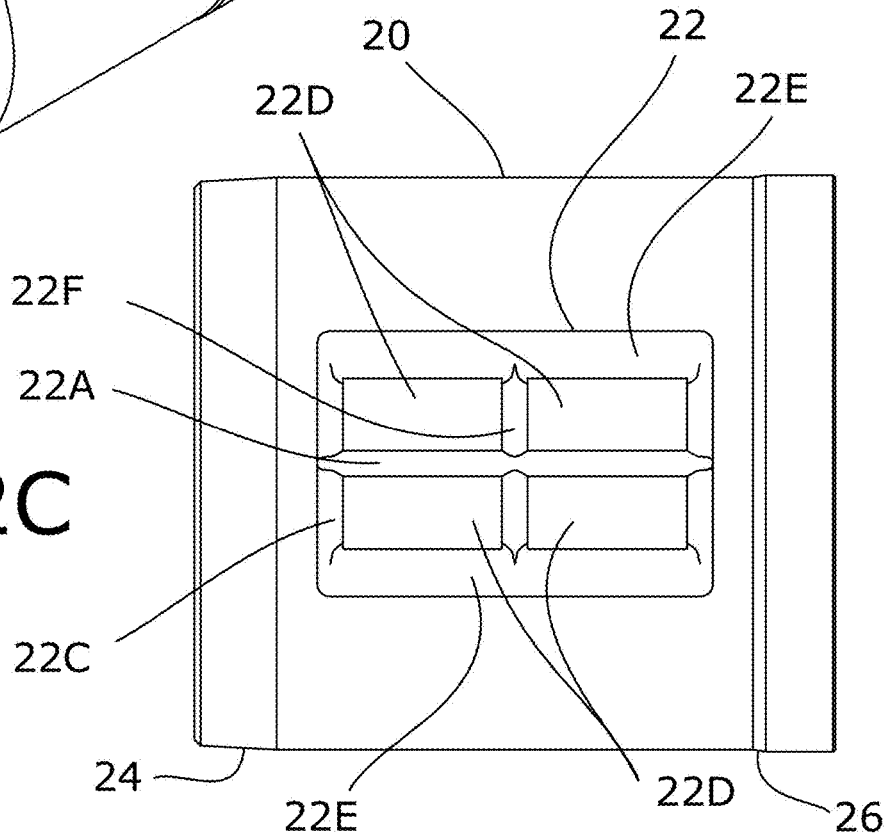
Fig. 2C

Fig. 3A
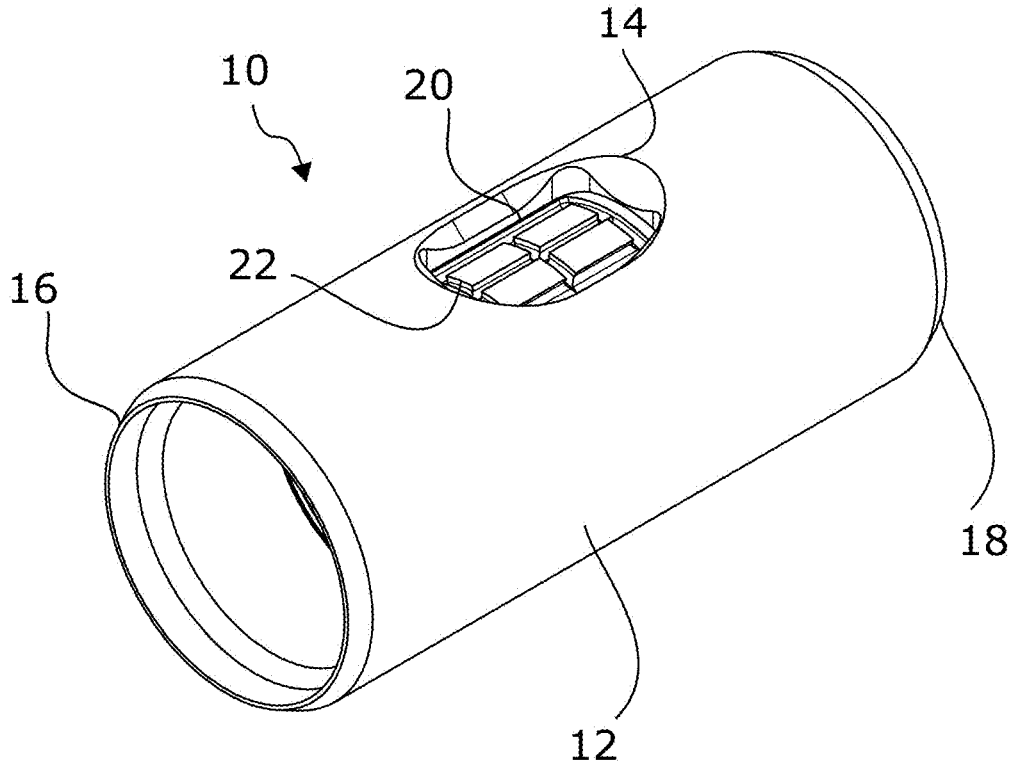
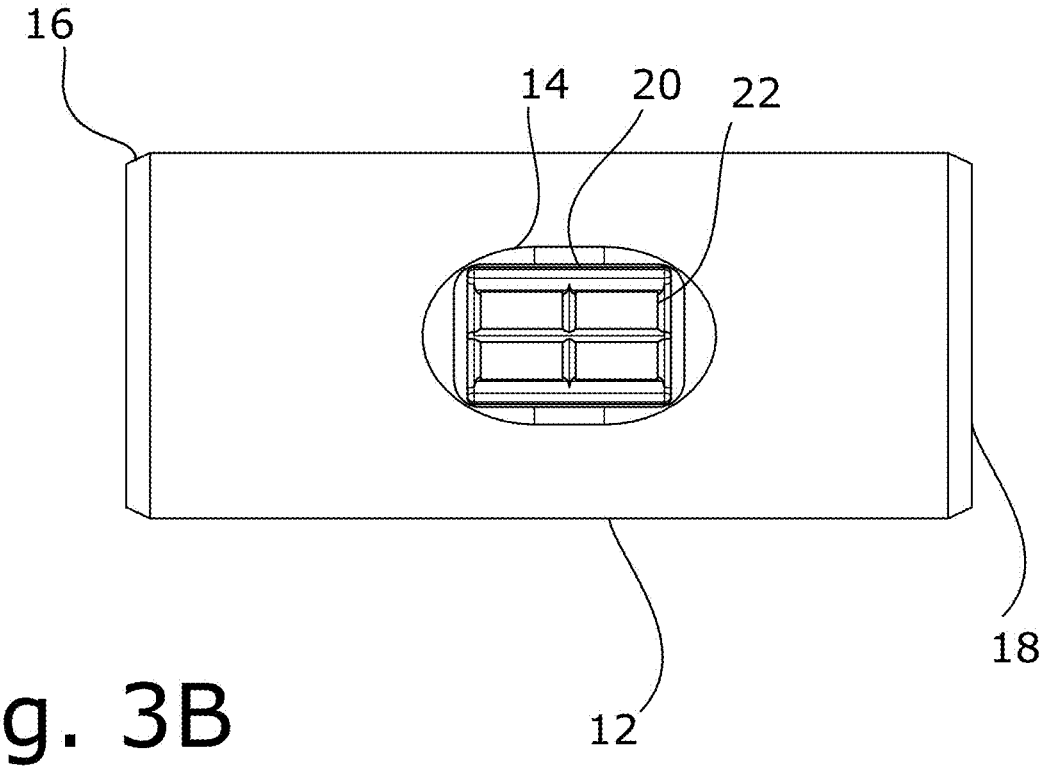
Fig. 3B

Fig. 4B
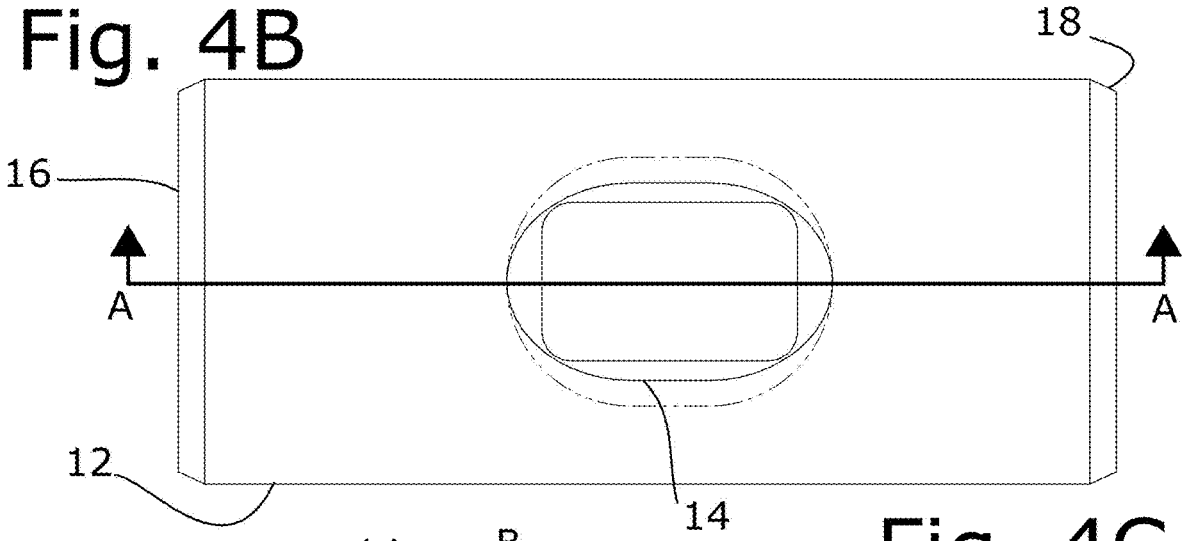
Fig. 4C
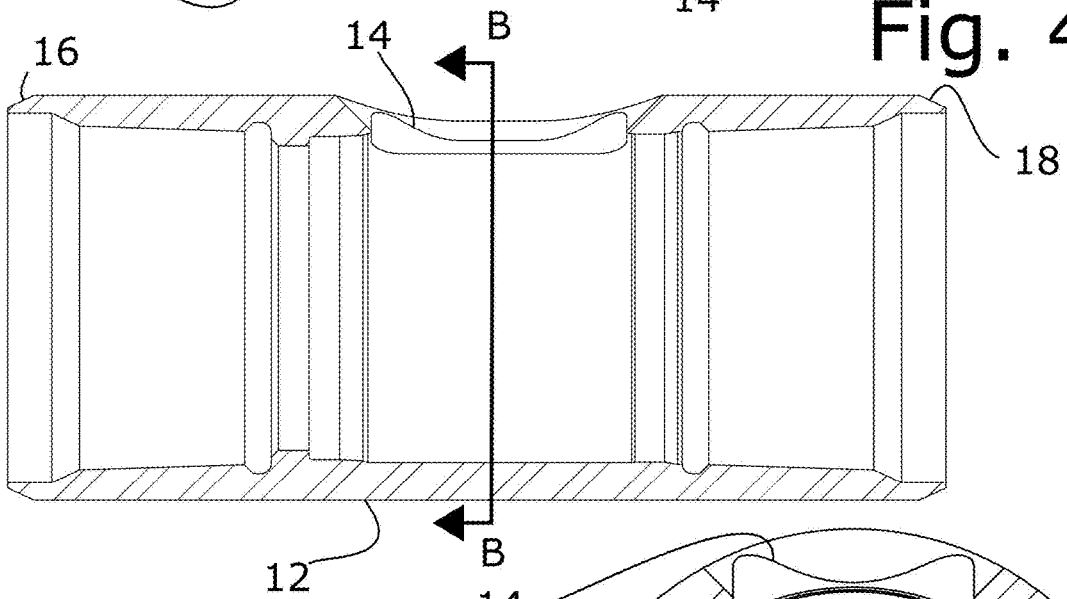
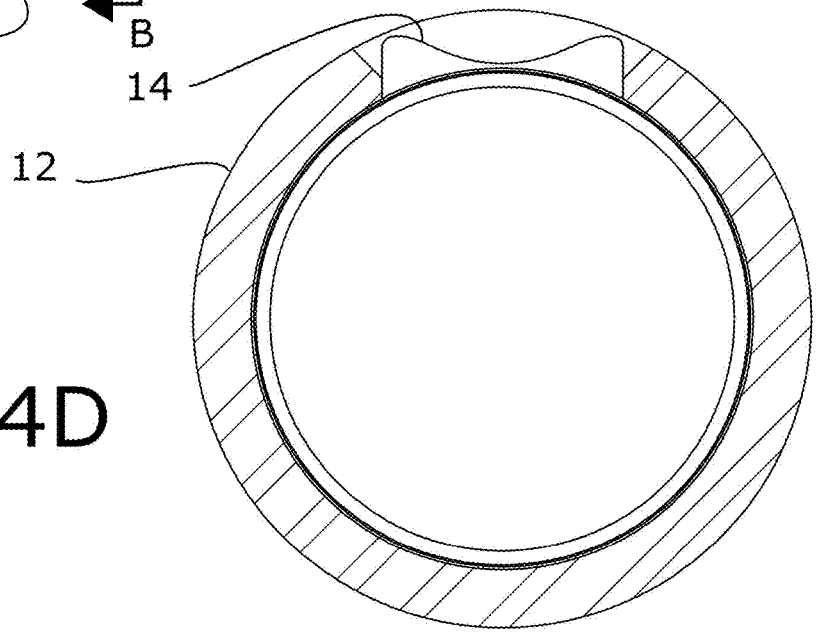
Fig. 4D

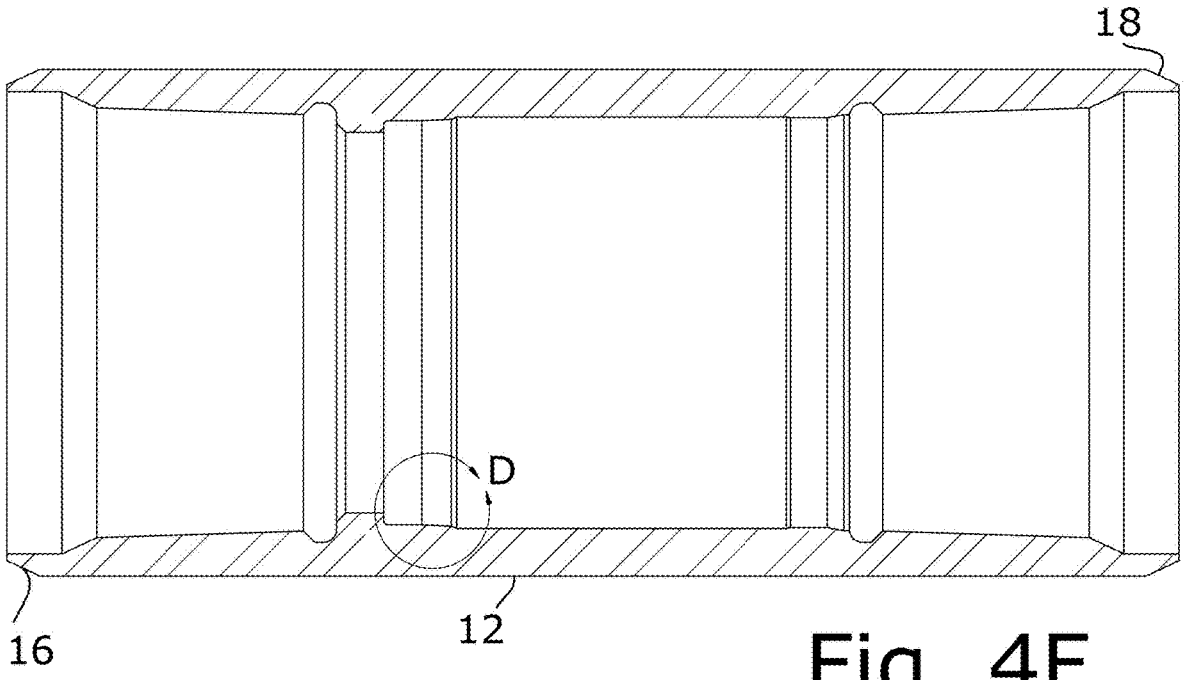
Fig. 4F
Fig. 4G
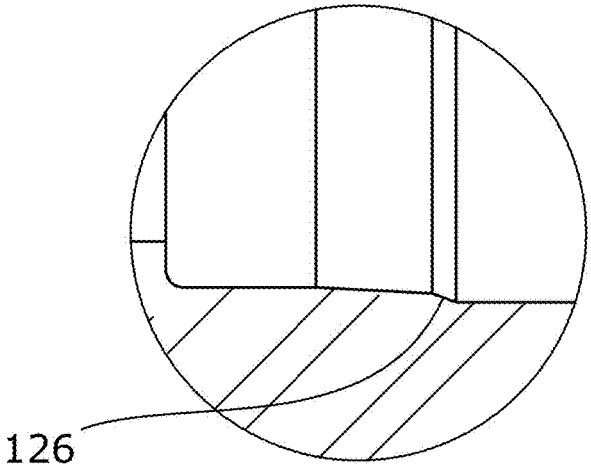

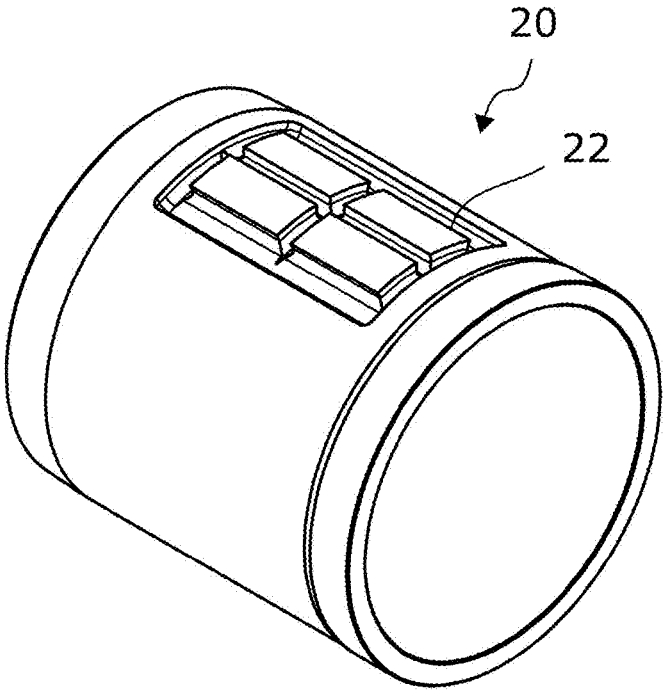
Fig. 5A
Fig. 5B
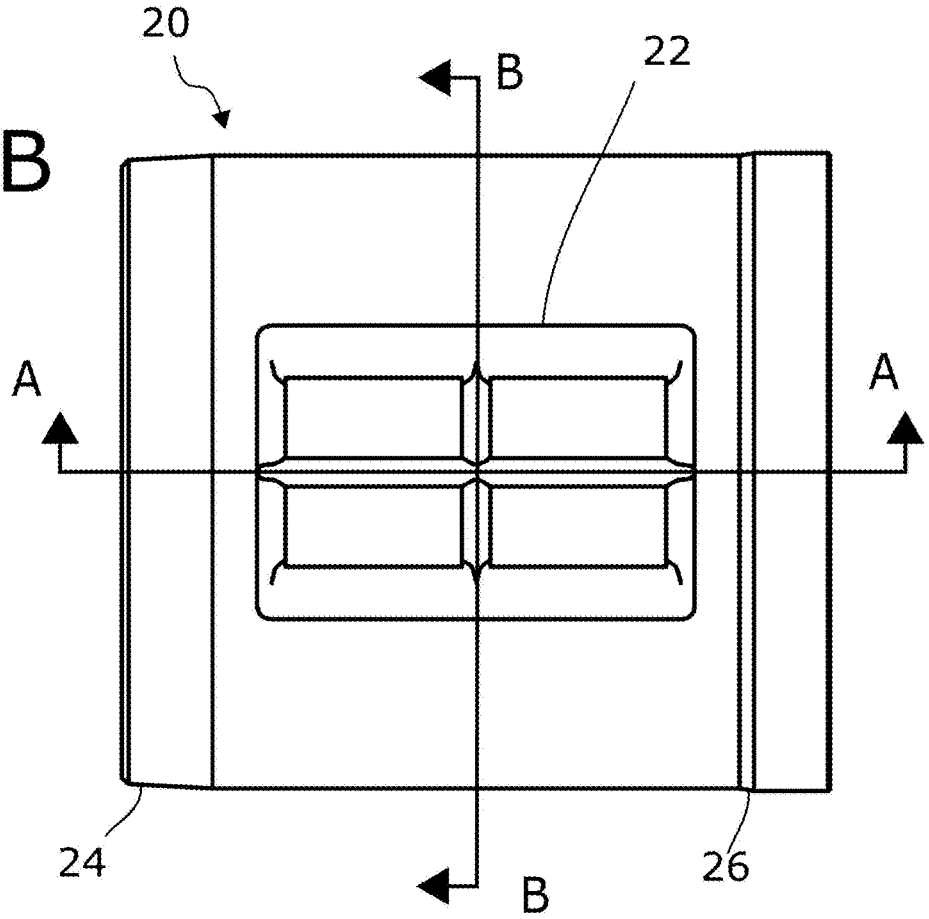

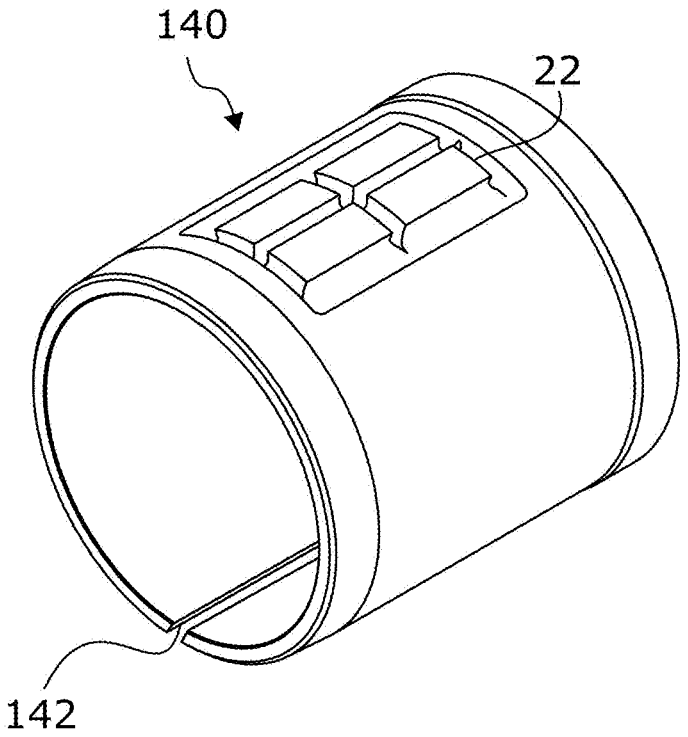
Fig. 9A
Fig. 9B
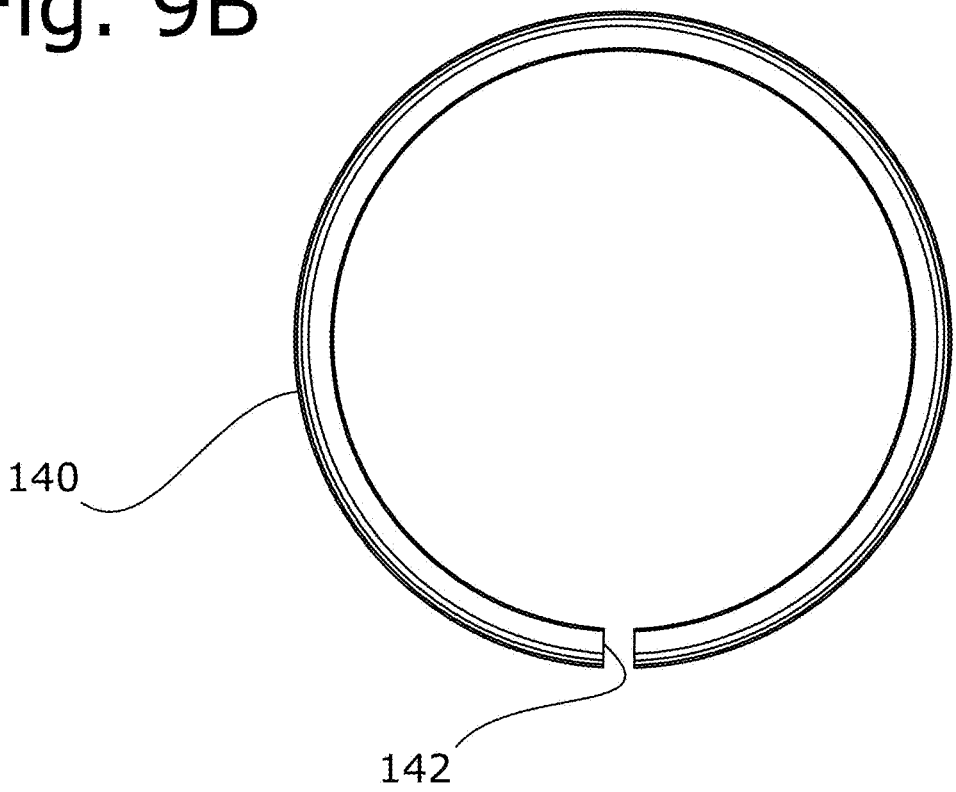

TUBING DRAIN WITH BURST INNER BODY

TECHNICAL FIELD

Tubing drains, especially tubing drains with burst elements.

BACKGROUND

In oil and gas extraction, casing is inserted into the well hole in the course of drilling and the casing is cemented in position. Depending on the nature of the formation and the intervening formations multiple layers of casing may be employed. After the casing has been secured, production pipe is inserted into the casing. Casing, production pipe and drill pipe typically comprise series of sections that are threaded together in a string. which are typically respectively called casing string, tubing string and drill string. In this document, the term "tubing string" also includes drill string. The production pipe extends into a formation where gas, oil or other materials may be located.

A tubing drain may be embedded in a tubing string to provide an outlet for fluids between the production string or drill pipe and the casing or surrounding formation. Some known tubing drains operate on the principle of a sacrificial downhole tool. The tool threads into the tubing string and a portion of the tool is designed to break or burst when exposed to targeted conditions, such as a surge in pressure.

SUMMARY

A tubing drain comprises an annular body and an inner body insertable into the annular body, the inner body being configured to rupture when exposed to a target condition, the annular body comprising a bore, a window between an exterior of the annular body and the bore and first and second connector ends, each connector end connectable to a respective tubing section in a tubing string.

In various embodiments, there may be included any one or more of the following features: the inner body comprising a sleeve; the inner body comprising a burst profile and at least a portion of the burst profile aligning with the window of the annular body; the target condition comprising a pressure differential across the burst profile; a burst profile comprises one or more cavities in the inner body; the cavities may be milled; one or more cavities comprises a central groove and the burst profile comprises two or more burst profile flaps, at least one burst profile flap positioned on each side of the central groove; the burst profile flaps are configured to burst open to a radius no more than 1%, 2%, 3%, 4% or 5% beyond the maximum radius of the annular body; the burst profile flaps are configured to burst open out to a radius less than or equal to a maximum radius of the annular body; one or more cavities comprises two or more perimeter grooves, each perimeter groove on a side of one of the burst profile flaps opposite the central groove; one or more cavities comprises one or more tangential grooves, each tangential groove running non-parallel with the central groove; the central groove being oriented parallel to the axis of the tubing drain.

In some embodiments, there may be included any one or more of the following features: the inner body having an inner diameter greater than an inner diameter of a tubing section of the respective tubing sections of the tubing string; the inner body being fastenable into the bore of the annular body under compressive stress; the inner body fastenable into the bore of the annular body by an interference fit between the inner body and at least a portion of the bore; the interference fit between the inner body and the annular body provides a seal preventing fluid flow between the bore and the window of the annular body; the inner body fastenable into the bore of the annular body by compression between two or more axially separated components in the tubing string; two of the axially separated components in the tubing string comprising the respective tubing sections; two of the axially separated components in the tubing string comprising one of the respective tubing sections and a structure in the bore of the annular body; the structure of the bore of the annular body comprising a shoulder in the bore defined by a reduced internal diameter; the annular body comprising a first body portion, the first axially separated component comprising a stop in the first body portion, and a second body portion, the second axially separated component comprising a stop in the second body portion, the second body portion threadable onto the first body portion to fasten the inner body between the first body portion and the second body portion.

In further embodiments, there may be included any one or more of the following features: the inner body has an outer diameter over at least a portion of its length greater than an inner diameter of a tubing section connectable to at least one of the first and second connector ends; the inner body comprises AISI 1026 steel; the annular body comprises L80 steel heat treated to HRC 22 maximum; the inner body comprises a first shoulder or tapered edge at a first end of the inner body, the first shoulder or first tapered edge having an average exterior diameter larger than an exterior diameter of a central portion of the inner body; the inner body comprising a second shoulder or tapered edge at a second end of the inner body, the second shoulder or tapered edge having an average exterior diameter smaller than the exterior diameter of the central portion of the inner body.

In some embodiments, a tubing drain comprises a first annular body portion with a male threaded first end, a second annular body portion with a female threaded first end, the female threaded end receiving the male threaded first end of the first annular body portion and a sacrificial inner body insertable into the second annular body portion of the tubing drain, the inner body configured to rupture when exposed to a targeted pressure differential.

These and other aspects of the device and method are set out in the claims.

BRIEF DESCRIPTION OF THE FIGURES

Embodiments will now be described with reference to the figures, in which like reference characters denote like elements, by way of example, and in which:

FIG. 1C is a front view of a tubing drain according to FIG. 1A.

FIG. 1D is a cross-section view taken through the section A-A in FIG. 1C.

FIG. 2A is a perspective view of a sleeve of a tubing drain according to FIG. 1A.

FIG. 2B is a perspective view of a sleeve in a burst state according to FIG. 2A.

FIG. 2C is a plan view of the sleeve according to FIG. 2A.

FIG. 3A is a perspective view of a tubing drain according to an embodiment.

FIG. 3B is a plan view of a tubing drain according to FIG. 3A.

FIG. 4B is a top view of the tubing drain according to FIG. 4A.

FIG. 4C is a cross-section taken through the section A-A in FIG. 4B.

FIG. 4D is a cross-section taken through the section B-B in FIG. 4C.

FIG. 4F is a cross-section taken through the section C-C in FIG. 4E.

FIG. 4G is an expanded view of the detail D in FIG. 4F.

FIG. 5A is a perspective view of a sleeve according to a further embodiment.

FIG. 5B is a plan view of the sleeve according to FIG. 5A.

FIG. 9A is perspective view of a substantially annular inner body according to a further embodiment.

FIG. 9B is a front view of the inner body of FIG. 9A.

DETAILED DESCRIPTION

Figure 1A:
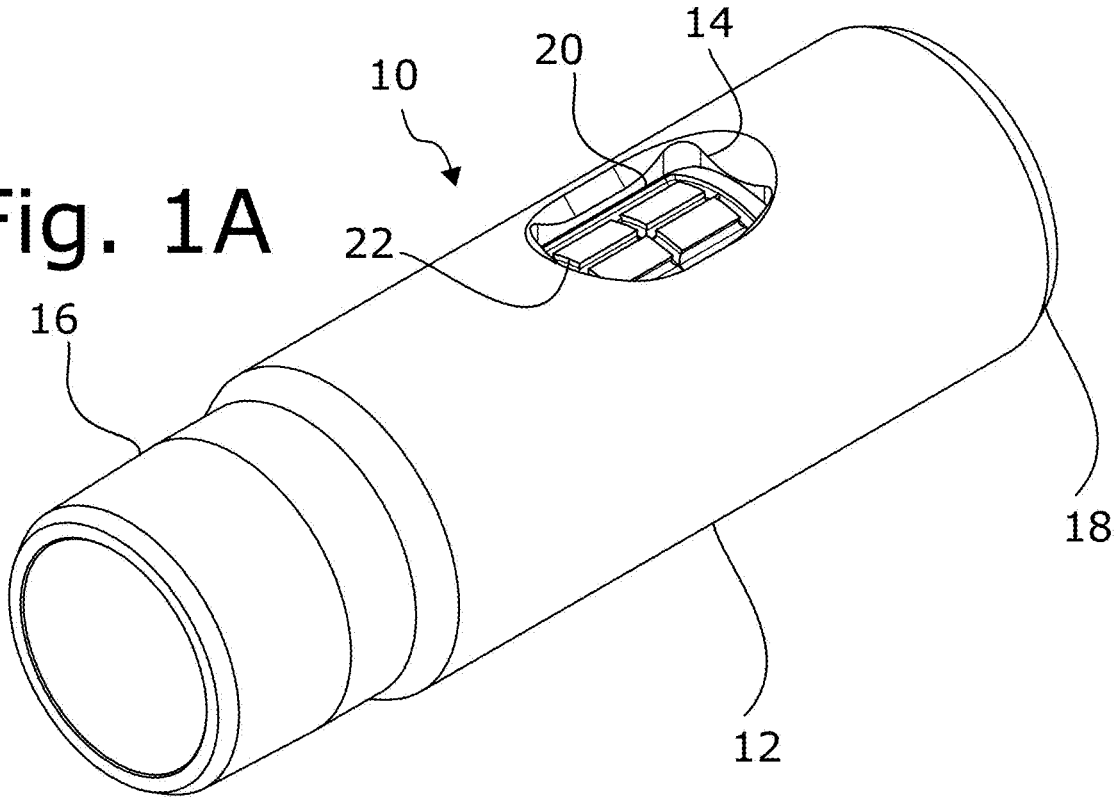
FIG. 1A is a perspective view of a tubing drain according to an embodiment.
Figure 1B:
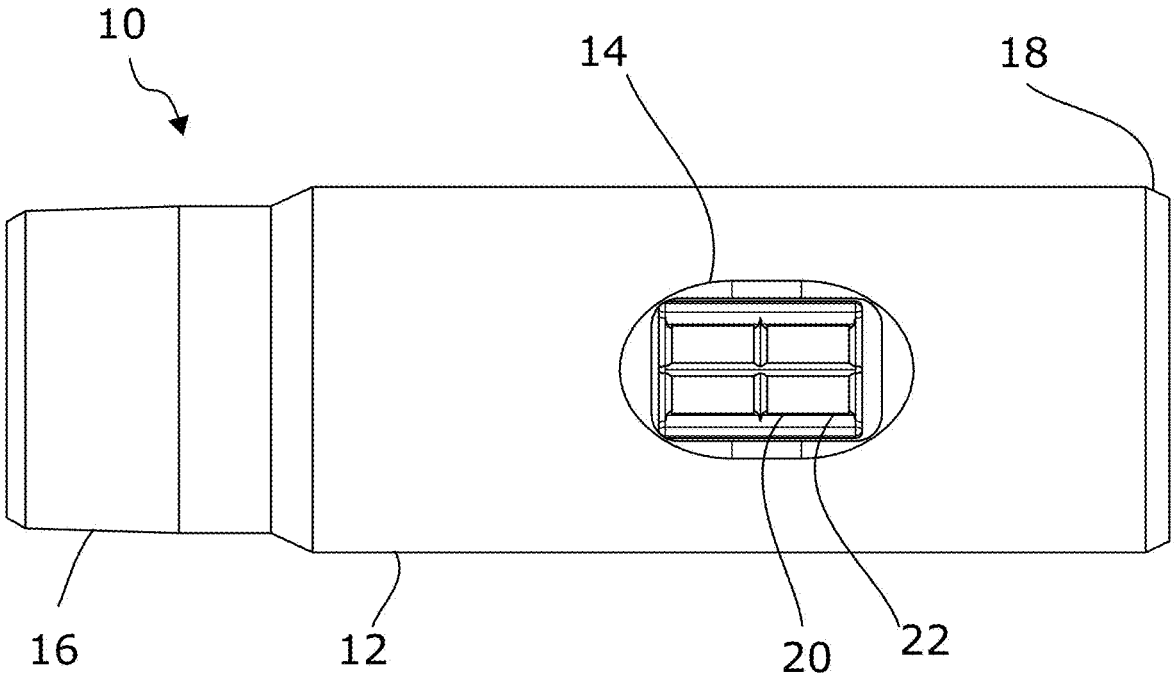
FIG. 1B is a plan view of a tubing drain according to FIG. 1A.

Immaterial modifications may be made to the embodiments described here without departing from what is covered by the claims.

In this description, the term "axial" is used to refer to the central axis of a tubing string unless otherwise specified. Similarly, the term "radial" refers to directions both perpendicular to and intersecting the central axis of a tubing string. The term "tangential" refers to directions perpendicular to both the axial direction and the radial direction at a given point in space off of the axis.

A tubing drain 10 is a downhole tool providing a configurable burst element within a tubing string. A tubing drain 10 has an approximately annular body 12 which may be fastenable into a tubing string, for example by threading or being press fit onto adjacent ends of tubing sections. A press fit may equivalently be referred to as an interference fit. A window 14 in the annular body provides a radial passage between the interior, i.e. the bore of the downhole tool, and the exterior of the annular body. The tubing drain 10 has first and second connector ends 16, 18, each connector end connectable to a respective tubing section in a tubing string. Connector ends 16, 18 may have threading on their interior or exterior surfaces permitting each connector end 16, 18 to thread into or onto an adjacent tubing section of a tubing string. The annular body 12 may have a pin x box configuration, e.g. with connector end 16 comprising a pin connection and connector end 18 comprising a box connection, as illustrated in FIGS. 1A through 1D. In some embodiments, the annular body 12 may have a box x box configuration, e.g. with both connector ends 16 and 18 comprising a box connection, as illustrated in FIGS. 3A-3D, FIGS. 4A-H, FIGS. 7A-7C, and FIGS. 8A-8C.

An inner body is insertable into the annular body 12 to provide a configurable burst element in the tubing drain 10. The inner body may have an annular shape. In this document an inner body having an annular shape is referred to as a sleeve 20 and various embodiments are described with reference to inner bodies comprising sleeves. However, various features described may be applicable to inner bodies with non-annular geometries.

In some embodiments, the inner body may have a substantially annular shape, such as the substantially annular inner body 140 in FIGS. 9A and 9B. An opening 142 in the shape of the inner body 140 provides a shape resembling an elongated snap ring or torc. In such embodiments, the inner body 140 may have an uncompressed exterior diameter that is greater than the inner diameter of a portion of the annular body 12. The inner body 140 may be compressed or flexed during or for insertion into the annular body 12, The restoring force caused by compression or flexion of the inner body 140 may produce or improve a seal between the exterior faces of the inner body 140 and the interior faces of the annular body 12. In some embodiments, the opening 142 may extend along an angle of as much as 90° or more around the central axis of the tubing drain.

Figure 10A:
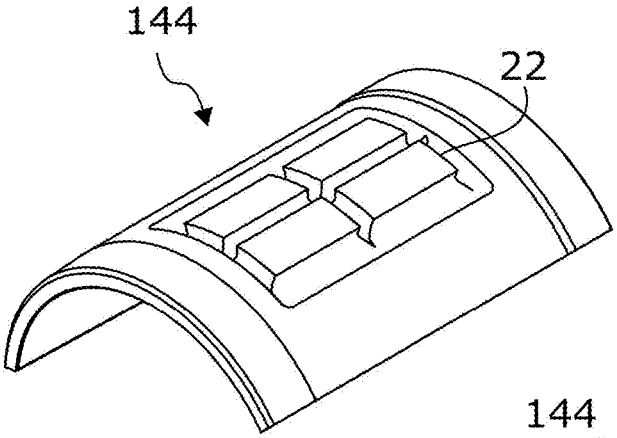
FIG. 10A is a perspective view of an inner body having an arcuate shape according to a further embodiment.
Figure 10B:
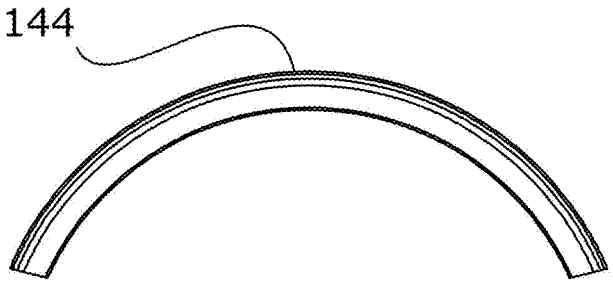
FIG. 10B is a front view of the inner body of FIG. 10A.
Figure 10C:
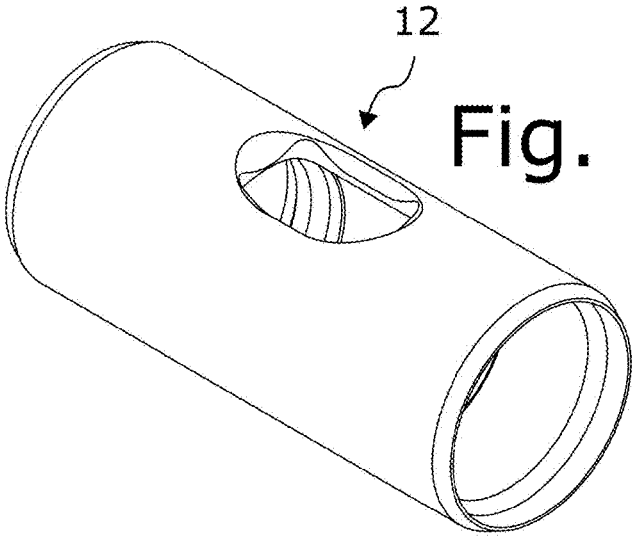
FIG. 10C is a perspective view of an annular body according to the embodiment of FIG. 10A.
Figure 10D:
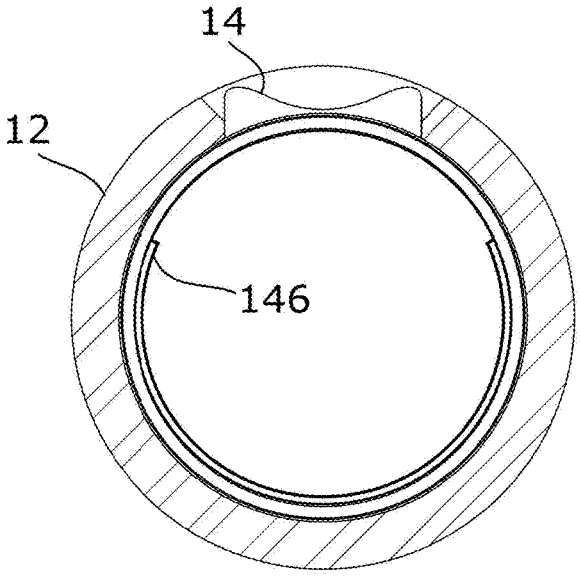
FIG. 10D is a front view of the annular body of FIG. 10C.

In another embodiment, the inner body may have a substantially arcuate shape 144, as illustrated in FIGS. 10A and 10B. The substantially arcuate shape 144 may insert into the annular body 12 along a structure 146 in the bore of the annular body having a complementary shape. In such an embodiment, the inner body may be sized to provide an interference or press fit when inserted into the bore of the annular body 12.

In embodiments in which the inner body comprises a sleeve 20, a portion of the sleeve 20 may include a burst profile 22 which may align with the window 14 of the annular body 12. A burst profile 22 may cover a fraction of the surface of the sleeve 20 and a fraction of the burst profile 22 may overlap with the window when inserted into the annular body 12. The burst profile 22 may have a shape conforming roughly to the shape of the window 14 in annular body 12. In some embodiments, burst profile 22 may be substantially larger or smaller than window 14 in annular body 12.

Burst profile 22 may comprise an area of sleeve 20 with modified surface or thickness. In some embodiments, this may comprise areas or segments of reduced radial thickness. For example, the burst profile 22 may comprise a milled profile in the sleeve. The milled portions of burst profile 22 may be configured to weaken the integrity of the of the sleeve so that the burst profile will rupture when the pressure differential across the burst profile 22 exceeds a target threshold. The pattern of the milled portions of the burst profile 22 may be selected for the burst profile 22 to rupture in a controlled or predictable manner. For example, in the burst profile 22 of FIGS. 2A through 2E, the milled rectangular exterior outside of the burst profile 22 of the sleeve may have a uniform or near uniform radial thickness.

Figure 6:
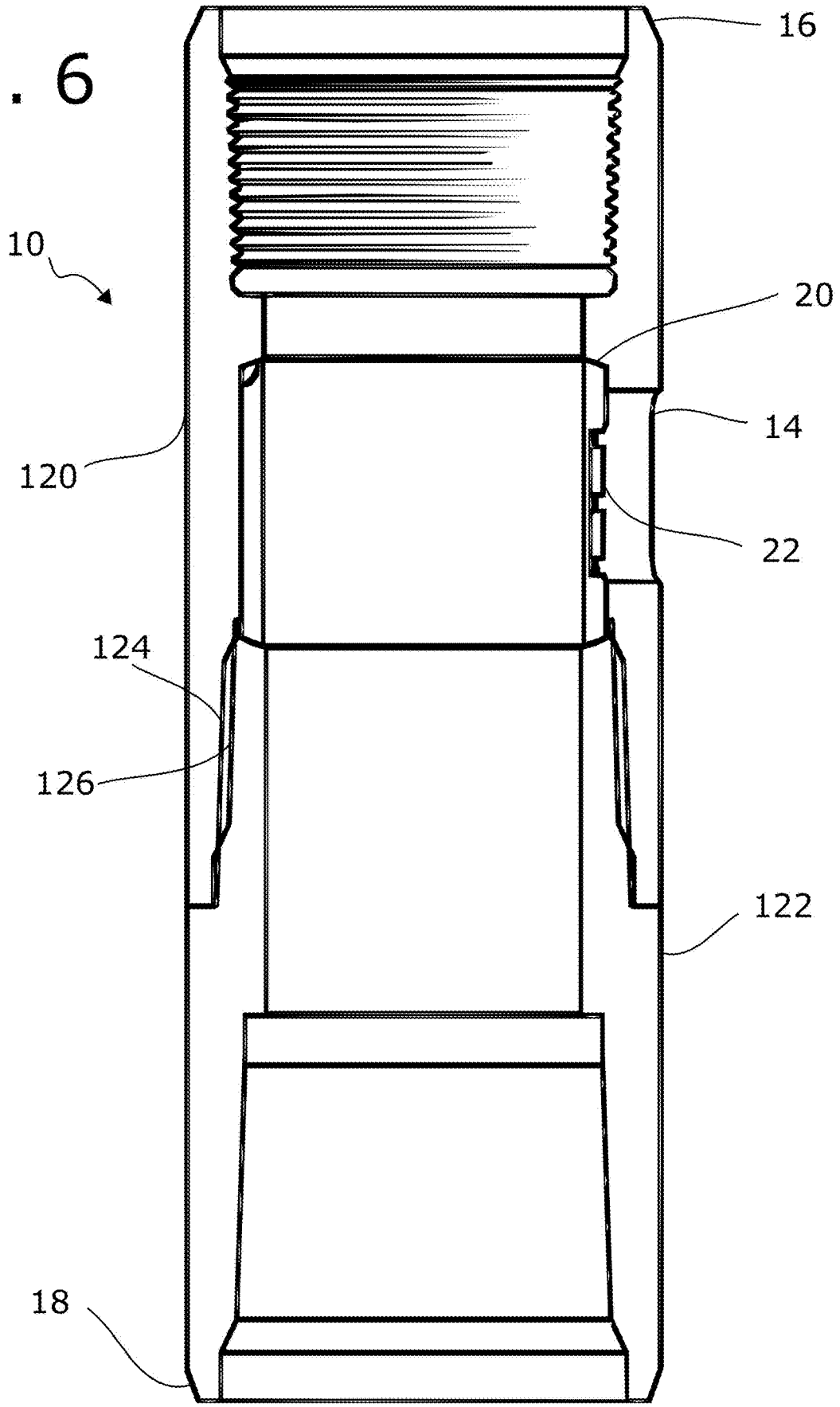
FIG. 6 is a cross-section view of a further embodiment of a tubing drain, the cross-section taken through a plane intersecting and parallel to the central axis of the tubing drain.
Figures 7A, 7B, 7C:
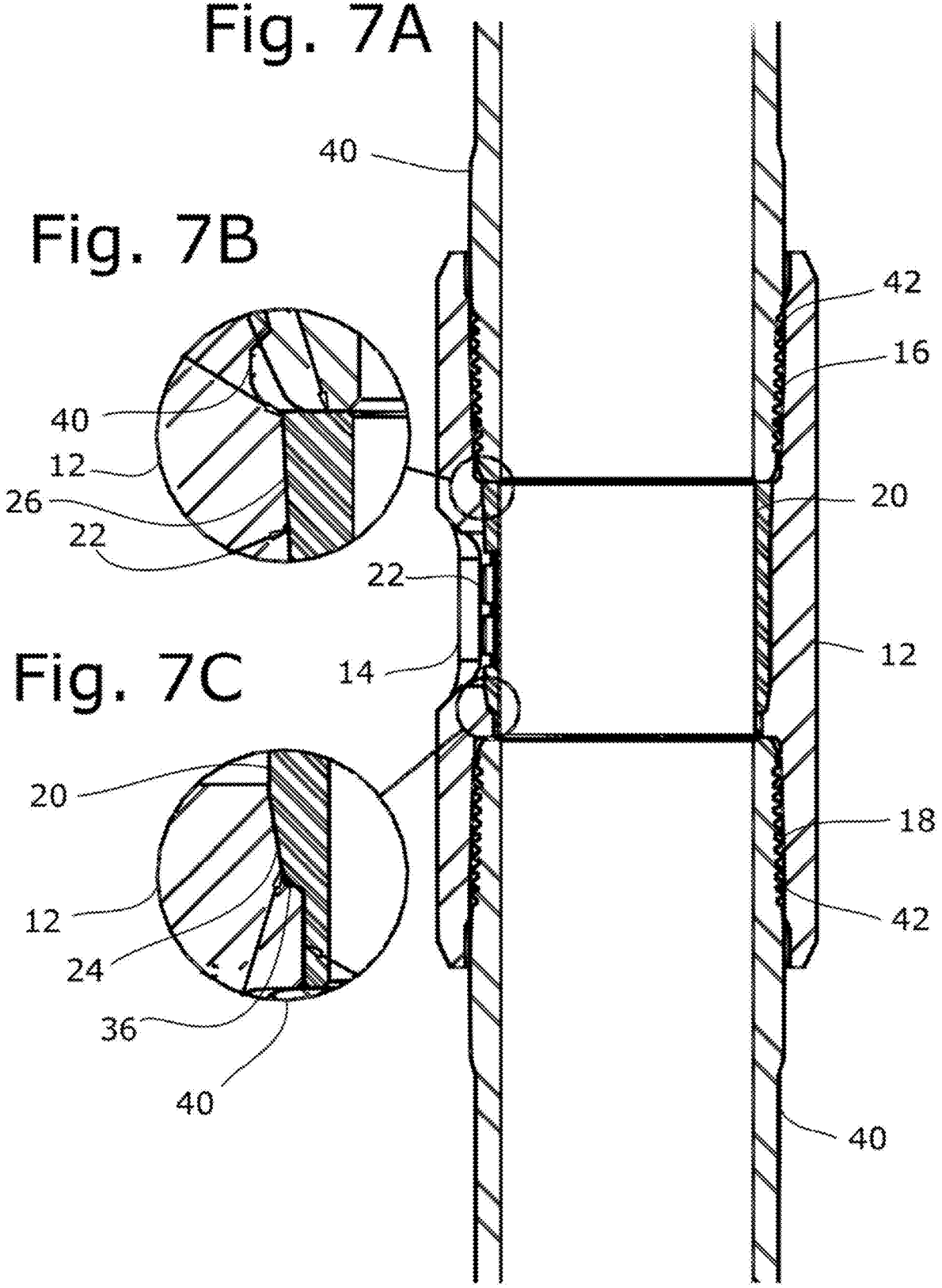
FIG. 7A is a cross-section view of a further embodiment of a tubing drain, the cross-section taken through a plane intersecting and parallel to the central axis of the tubing drain.
FIG. 7B is an expanded detail view of the intersection of a tubing section, a tubing drain body portion and a tubing drain sleeve in FIG. 7A.
FIG. 7C is an expanded detail view of the intersection of a tubing section, a tubing drain body portion and a tubing drain sleeve in FIG. 7A.
Figures 8A, 8B, 8C:
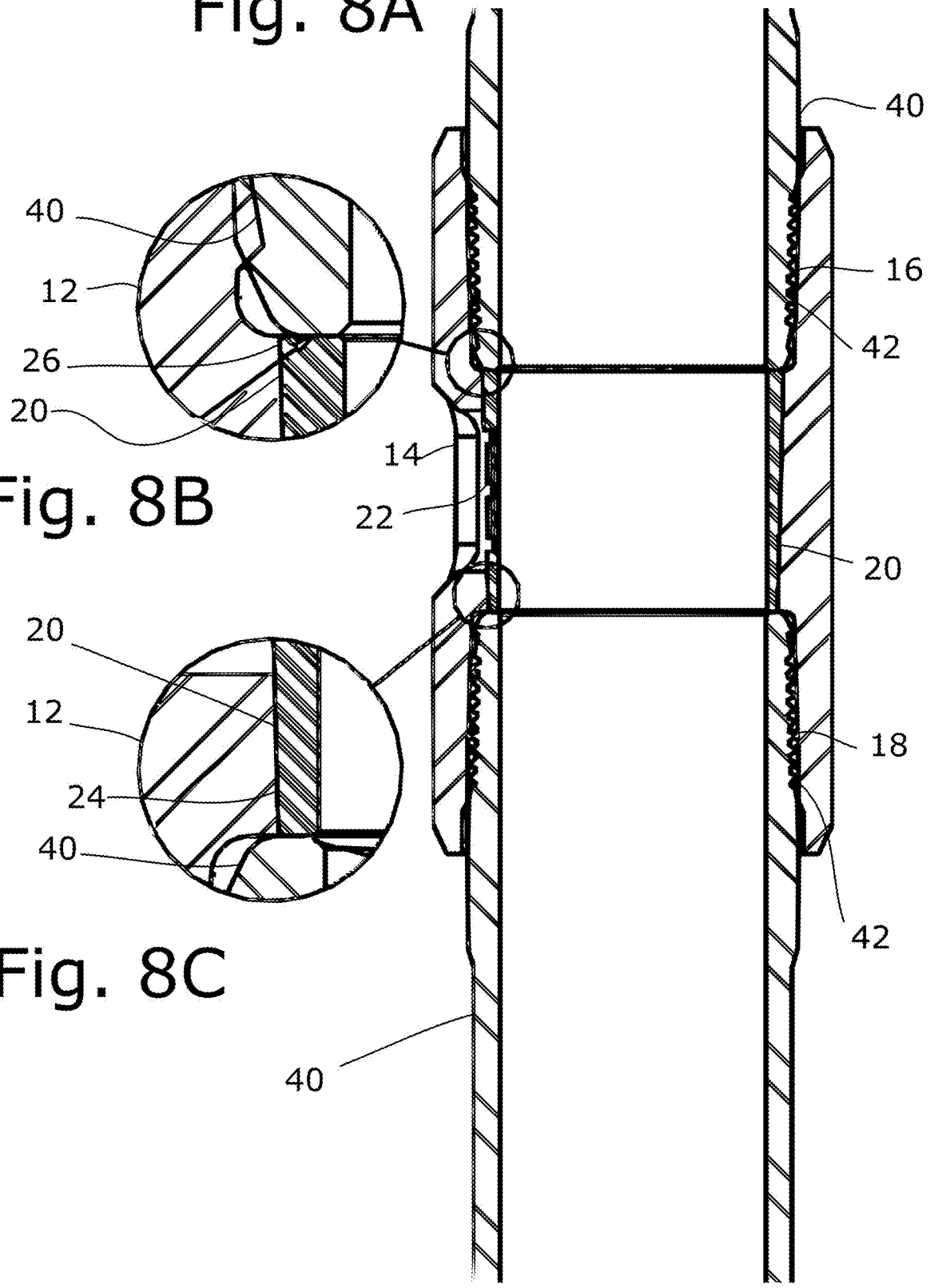
FIG. 8A is a cross-section view of a further embodiment of a tubing drain, the cross-section taken through a plane intersecting and parallel to the central axis of the tubing drain.
FIG. 8B is an expanded detail view of an intersection of a tubing section, a tubing drain body portion and a tubing drain sleeve in FIG. 8A.
FIG. 8C is an expanded detail view of an intersection of a tubing section, a tubing drain body portion and a tubing drain sleeve in FIG. 8A.

The burst profile 22 may be required to resist extreme environments of thermal wells including high temperatures (up to 370° C.) and highly corrosive environments, including fluids with significant proportions of $H_2S$. The internal sleeve has a burst profile and is inserted into the body of the tool. When pressure exceeds a target threshold, the profile bursts through an internal window in the body of the tool. A seal may be maintained between the sleeve and the body of the tool by a radial interference fit. The seal may be improved by the application of a sealant, such as a high temperature thread sealant. In embodiments using a sealant, a sealant may be selected to have suitable properties for the intended application of the tubing drain. A thread sealant may also lubricate the parts, assisting in the insertion process in producing the interference fit. A seal between the sleeve 20 and the annular body 12 may prevent fluid flow between the bore of the annular body 12 and the exterior of the annular body 12 through the window 14. Preloading the sleeve and body contact surfaces may improve the seal and apply beneficial compressive stress. Preloading the sleeve and body contact surfaces may be achieved by threading two tubing sections together at the connecting ends 16, 18 of the annular body 12. In some embodiments, this may comprise two adjacent tubing sections threading together into the body of the tool, and pressing directly into the sleeve, as illustrated in FIGS. 7C and 8C. In some embodiments, this may comprise an adjacent tubing section threading into a thread of the body of the tool, pressing the sleeve into a slot in the body of the tool, as illustrated in FIG. 1D (adjacent tubing section not shown in this figure). In some further embodiments, the body of the tool may comprise two separable portions which thread into each other, and the sleeve may fit into a slot in one or both of the body portions, with pressure applied along the sleeve faces by threading the two separable portions into each other, as illustrated in FIG. 6.

In some embodiments, burst profile 22 may have one or more portions of reduced relative thickness, such as grooves, which provide weakened portions of the burst profile for a rupture event. For example, a burst profile 22 may have a central groove 22A cut axially along the sleeve with a calibrated reduced thickness 22B as an initiation site for the rupture, as illustrated in FIGS. 2A-2E and 5A-5F. Tangential grooves 22C along the perimeter may allow the crack to propagate tangentially, creating two flaps 22D. Wider, perimeter axial grooves 22E may act as hinge for the flaps. Thicker rectangular sections of the flaps 22D may provide rigidity and weight to the flaps 22D and may help keep them open fully after burst. A central relief groove 22F may provide flexibility to the flaps and may benefit the rupture process by tending to cause the initial rupture point to occur centrally in the central axial groove 22A. In some rupture events burst profile may rupture along one of central groove 22A and central relief groove 22F, or both.

Grooves 22C, 22E, and 22F may have thicknesses 22G, 22H, and 22I calibrated according to their function in the burst process. Calibrated thicknesses 22B, 22G, 22H and 22I may be equal or different in various embodiments. For example, the calibrated reduced thickness 22B of the central groove 22A may be thinner than the calibrated thickness 22G of the tangential grooves 22C, which may be thinner than the calibrated thickness 22H of the perimeter axial grooves 22E. In this document, any portion of the sleeve of reduced thickness relative to surrounding portions of the sleeve is referred to as a "cavity". The lengths and thicknesses of the various grooves may be calibrated to limit the size of the flaps 22D and the angle to which they open, so that, for example, the flaps open out to a radius less than the maximum radius of the annular body, to a radius equal to the maximum radius of the annular body, or to a radius no more than, for example, 1%, 2%, 3%, 4% or 5% beyond the maximum radius of the annular body. The flaps 22D may in some embodiments may be substantially contained within the window 14 after a rupture event. Containing the flaps within the maximum radius of the annular body 12 may prevent contact between the flaps and other structures in the well that could cause damage to other structures such as the casing and that could interfere with tripping out of the well. Keeping the radius only slightly larger than the maximum radius of the annular body can reduce interference and damage relative to the radius being much larger than the maximum radius of the annular body.

The inner diameter of the sleeve may be made greater than an inner diameter of the tubing, for example an inner diameter of the tubing sections connected to the annular body 12, to protect the inner surface of the sleeve from wear due to, e.g. a sucker rod sliding or rotating on it.

Figure 3C:
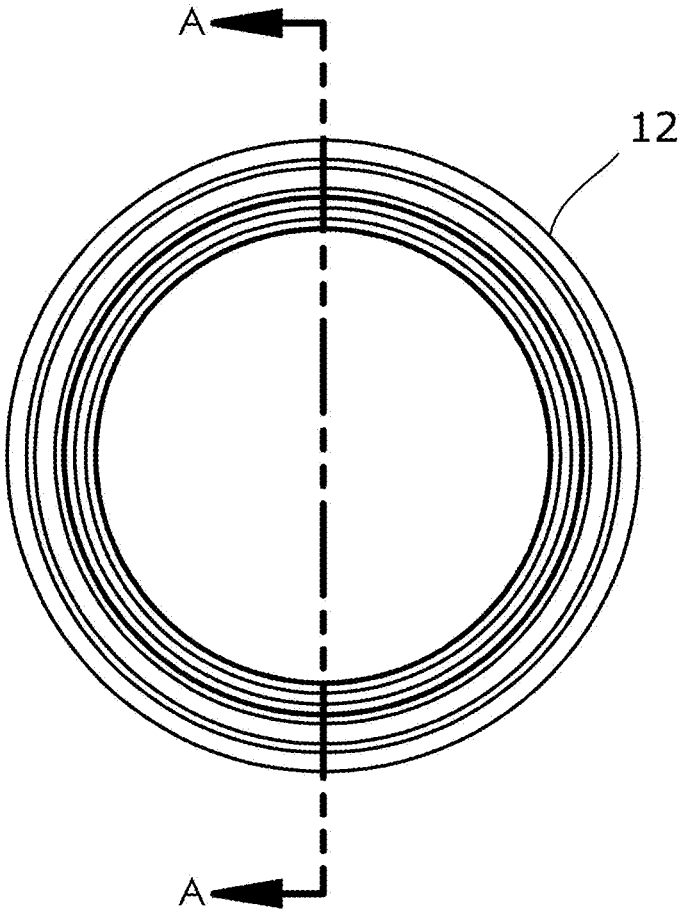
FIG. 3C is a front view of the tubing drain according to FIG. 3A.
Figure 3D:
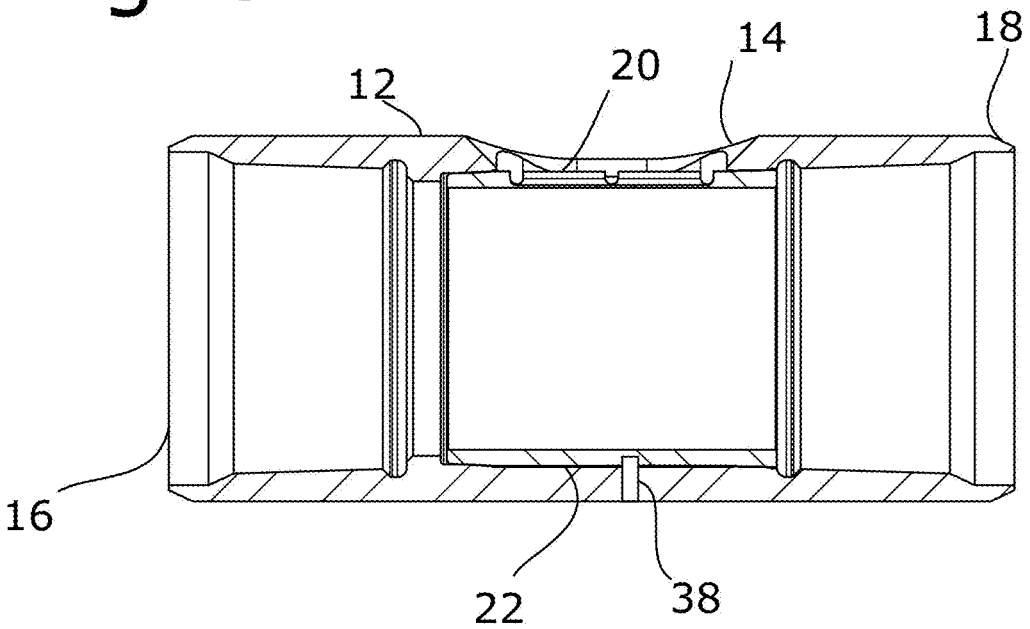
FIG. 3D is a cross-section view taken through the section A-A in FIG. 3C.
Figure 4A:
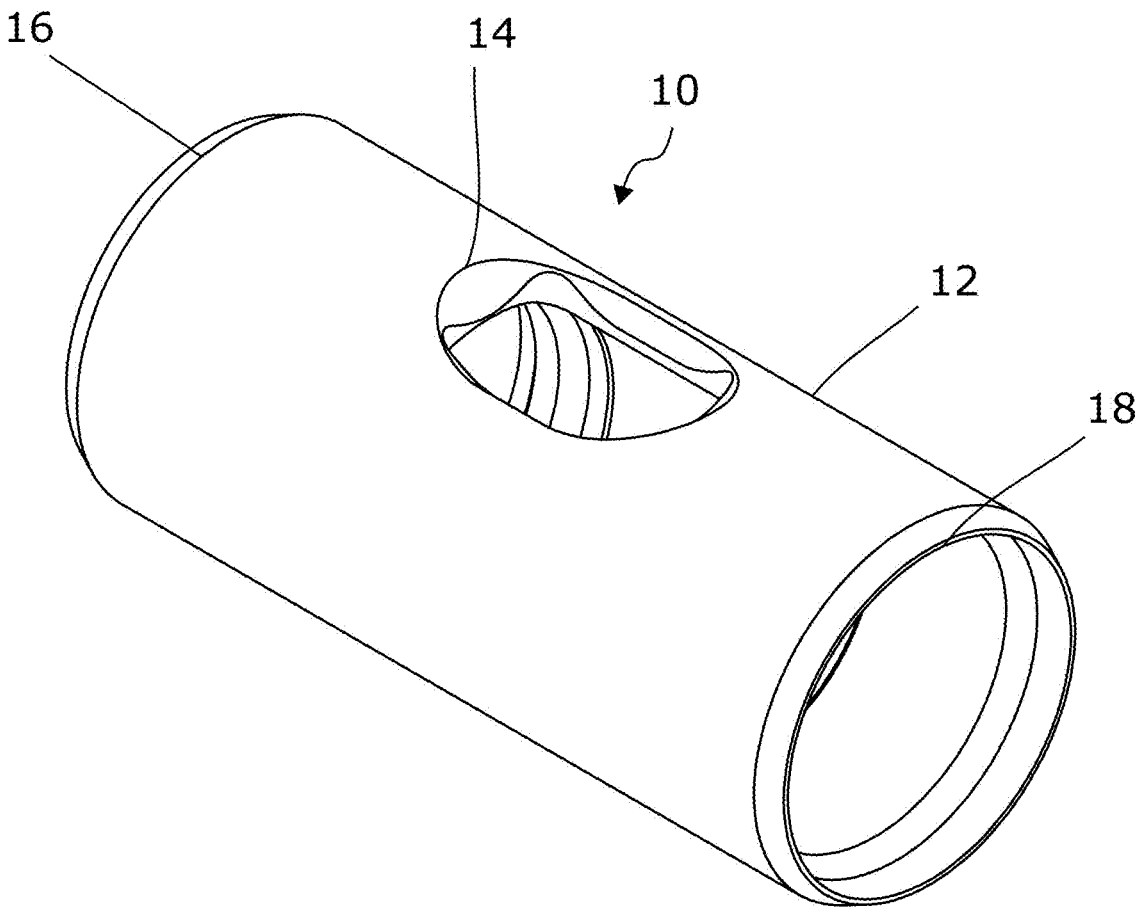
FIG. 4A is a perspective view of a tubing drain without a sleeve according to an embodiment.
Figure 4E:
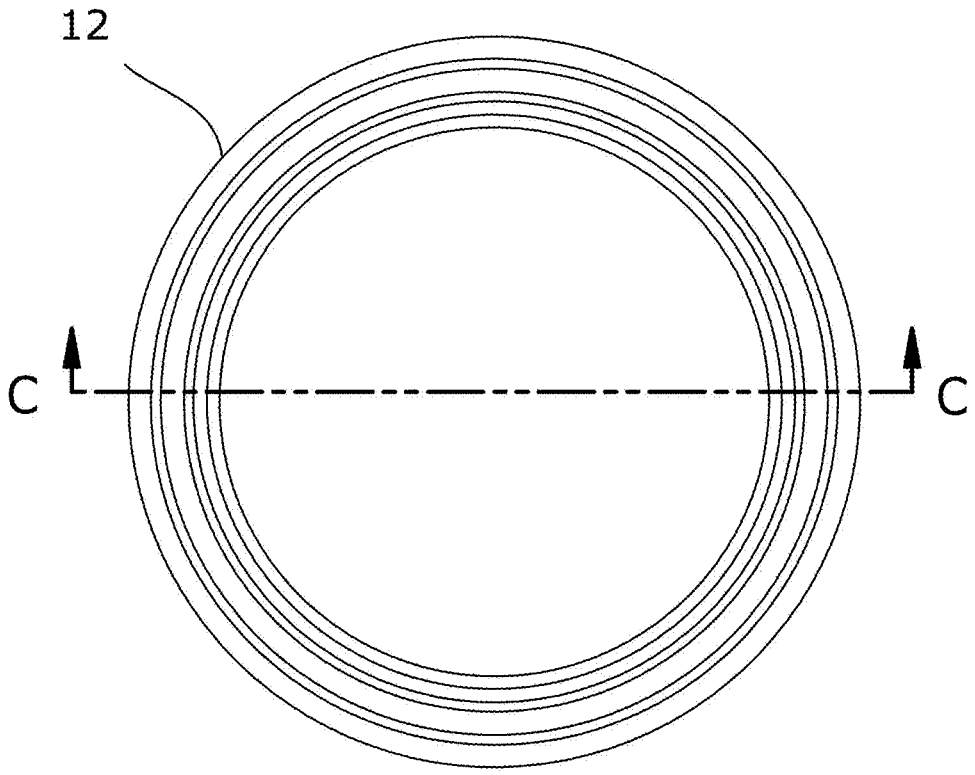
FIG. 4E is a front view of the tubing drain according to FIG. 4A.

In some embodiments, a through pin or set screw 38, as shown in FIG. 3D, may be used for alignment of the sleeve in the body of the tubing drain. In some embodiments, an internal key could be provided in the form of an internal axial keyway, such as an axial protrusion in the sleeve 20 and a corresponding groove in the bore of axial body 12, or an axial protrusion along the bore of axial body 12 and a corresponding groove in the sleeve 20.

In some embodiments, the sleeve 20 may have a burst profile 22 defined by differential thicknesses produced by methods other than milling. For example a reduced section may be produced by electrical discharge machining. In another example, a reduced section may be produced by 3D printing the desired profile. In some embodiments, a burst profile may be fabricated with the reduced section, e.g. with grooves or other cavities in the burst profile provided in a mould during a casting process.

When inserted into annular body 12, the sleeve 20 may seat against a stop in the interior of the bore of the annular body, such as an interior shoulder 126 in the annular body 12 of tubing drain 10, as shown in FIG. 4G. In some embodiments, a stop may be provided by a shoulder, a taper or other stop in the surface of the bore. In such embodiments, sleeve 20 may have an outer diameter over at least a portion of its length that is greater than an inner diameter of a portion of the annular body. In some embodiments, in order to be insertable into annular body 12 of tubing drain, sleeve 20 may have an outer diameter that is less than an inner diameter of at least one of the connector ends 16, 18 of annular body 12.

In some embodiments, sleeve 20 may be held in place within annular body 12 by the connection of tubing drain 10 into the tubing string. Adjacent tubing sections 40 may bear against adjacent ends of the sleeve 20 when threaded onto the annular body 12, as illustrated in FIGS. 7A-7C and 8A-8C. In such embodiments, sleeve 20 has an outer diameter over at least a portion of its length that is greater than an inner diameter of threaded ends 32 of tubing sections 40.

Figure 2D:
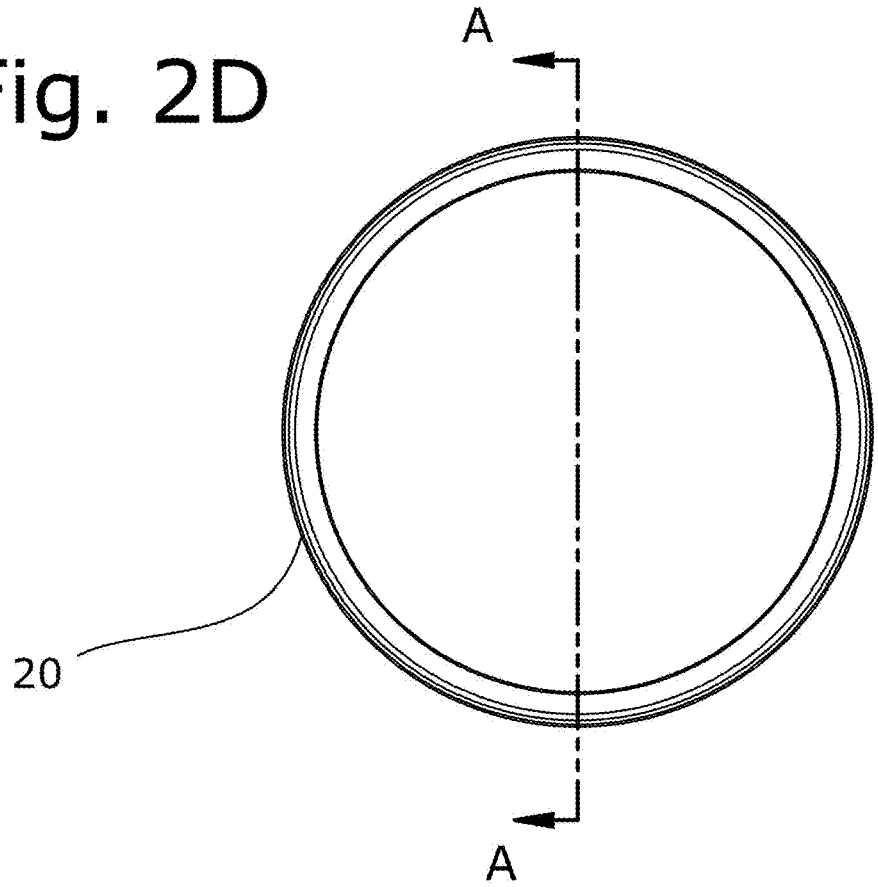
FIG. 2D is a front view of the sleeve of according to FIG. 2A.
Figure 2E:
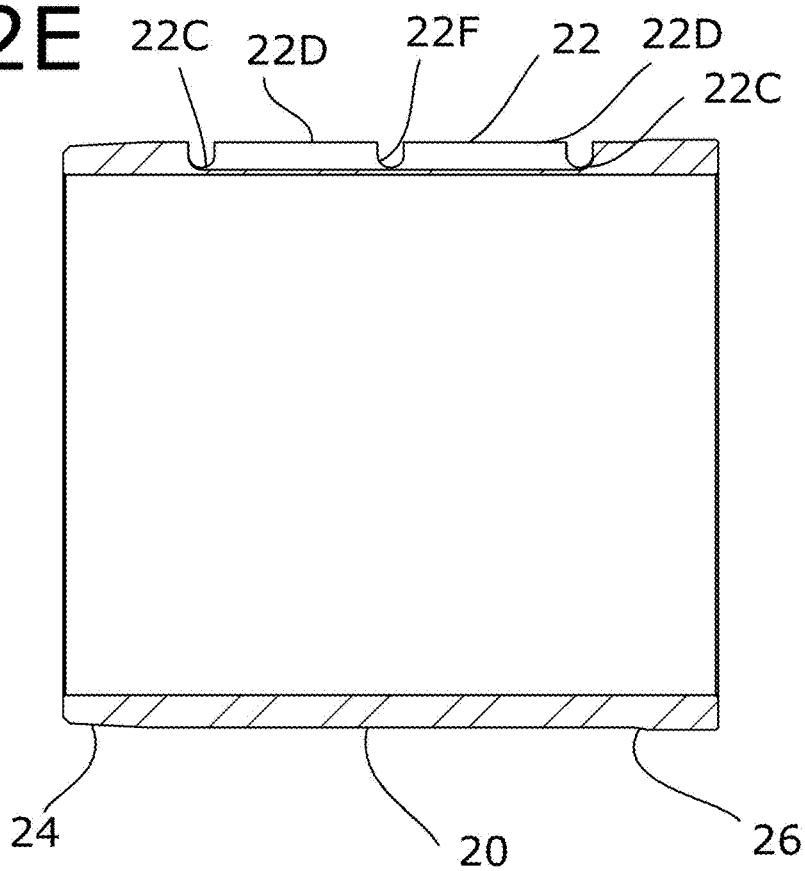
FIG. 2E is a cross-section view taken through the section A-A in FIG. 2D.

In some embodiments, the sleeve 20 may fasten into annular body 12 by means of a press fit. Mating sealing faces may be cylindrical or tapered. A narrowing taper 24 and a widening taper 26 at opposing ends of the sleeve, as shown in FIGS. 2C and 2E, may provide tapering surfaces on the sleeve for mating with matching tapers in annular body 12. A metal-to-metal seal may be beneficial in high temperature environments. A high temperature thread sealant/lubricant can be applied to sealing faces to seal micro leak paths and prevent galling on assembly In some embodiments, shrink fitting (using heat or cooling) is possible for assembly of the sleeve 20 for a tighter fit. In some embodiments, axial compression can be applied to assist in the press fit, with compression applied by the mating tubing pin nose of an adjacent tubing section 40, with the sleeve 20 seating at an internal shoulder of the annular body 12, such as shoulder 126. In some embodiments, crush washers (not shown) may be incorporated to improve a seal. The sleeve 20 may have a sacrificial "bump" around its OD or on one or both end faces that yields to create a seal when under load.

In some embodiments, annular body 12 may comprise two or more separable body portions 120, 122, as illustrated in FIG. 6. A first body portion 120 and second body portion 122 may have corresponding connecting body portion ends 124, 126. First body portion 120 and second body portion 122 may connect to each other, such as by a press fit between the two connecting body portion ends 24, 126, or by threading the first body portion 120 and second body portion 122 into each other by threads on each of corresponding connecting body portion ends 124, 126. Sleeve 20 may seat between the first and second body portions 120, 122 such as against a stop in each body portion. A stop may comprise a structure in the bore of a body portion, such as a shoulder, taper or other stop. In such embodiments, window 14 of annular body 12 may be provided as a window in a single one of first body portion 120 or second body portion 122. In a further embodiment (not shown), window 14 of annular body 12 may be provided as a partial window portion in each of first body portion 120 and second body portion 122, with the two window portions merging when first body portion 120 and second body portion 122 are fastened together.

Environmental cracking refers to corrosion cracking caused by one or more conditions that result in one or more stress corrosion cracking (SCC), corrosion fatigue and hydrogen embrittlement. Stresses that cause environmental cracking arise from residual cold work, welding, grinding, thermal treatment, or may be externally applied during service and, to be effective, are typically tensile (as opposed to compressive).

Stress corrosion cracking (SCC) is cracking induced from the combined influence of tensile stress and a corrosive environment. Cold deformation and forming, welding, heat treatment, machining and grinding can introduce residual stresses. The build-up of corrosion products in confined spaces can also generate significant stresses. Failures due to stress corrosion cracking can be sudden and catastrophic for the structure subject to the corrosion.

Corrosion fatigue is the result of the combined action of alternating or cycling stresses and a corrosive environment. If the metal is simultaneously exposed to a corrosive environment, the failure can take place at even lower loads and after shorter time. In a corrosive environment the stress level at which it might be assumed a material has an effectively infinite lifespan is lowered.

Hydrogen embrittlement a type of deterioration which can be linked to corrosion and corrosion-control processes. It involves the ingress of hydrogen into a component, an event that can seriously reduce the ductility and load-bearing capacity, cause cracking and catastrophic brittle failures at stresses below the yield stress of susceptible materials. Hydrogen embrittlement occurs in a number of forms but the common features are an applied tensile stress and hydrogen dissolved in the metal. Hydrogen embrittlement can be a particular issue for steel components in that hydrogen may diffuse along grain boundaries and combine with the carbon in steel. This process can make various types of steel brittle over time resulting in failure of steel parts. This can be a problem in various downhole components because of the presence of $H_2S$ and other acids in oil and gas wells.

To reduce risks from hydrogen embrittlement, components for parts of a downhole tool may be selected that have improved resistance to hydrogen embrittlement, corrosion fatigue and SCC. Shotpeening may also be used to produce additional compressive surface stresses, especially in the cavities of the inner body. Corrosion may also be reduced by surface coatings such as Electroless Nickel Coating (ENC). Materials may also be selected based on other mechanical properties for a given application of the downhole tool. For example, a sleeve 20 may comprise AISI 1026 steel and the annular body 12 may comprise L80 steel heat treated to 22 HRC maximum. A tubing drain 10 produced largely or entirely from these materials may satisfy the NACE International requirements for high-temperature sour gas wells. Alternatively, other corrosion resistant materials may be used for either or both of the annular body 12 and sleeve 20. Other suitable materials for some applications may include other steel alloys, Inconel™ alloys, and brass alloys, among others. In some embodiments, due to press fit and axial compression, sleeve 20 is preloaded with compressive forces. The compression and lack of tensile stresses may reduce likelihood of SSC. Preloading may also help reduce cyclical stresses. In embodiments with tapered faces, the tapering may increase forces and centralize. The compressive stresses may reduce susceptibility to stress corrosion cracking.

Figure 5C:
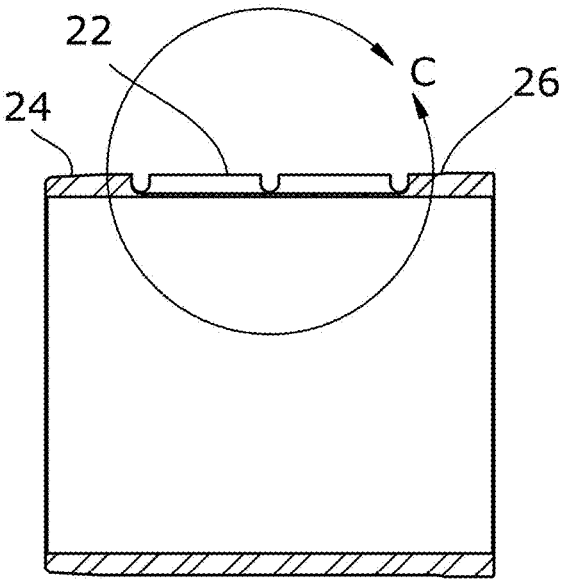
FIG. 5C is a cross-section view taken through the section A-A in FIG. 5B.
Figure 5D:
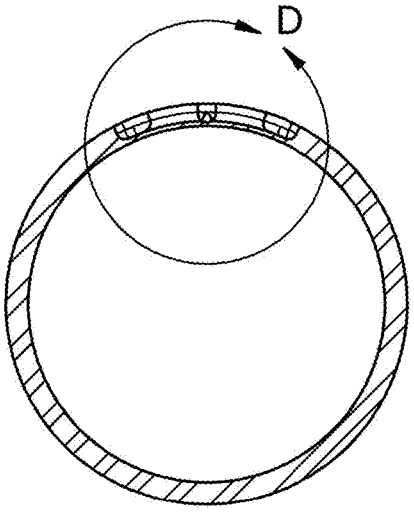
FIG. 5D is a cross-section view taken through the section B-B in FIG. 5B.
Figure 5E:
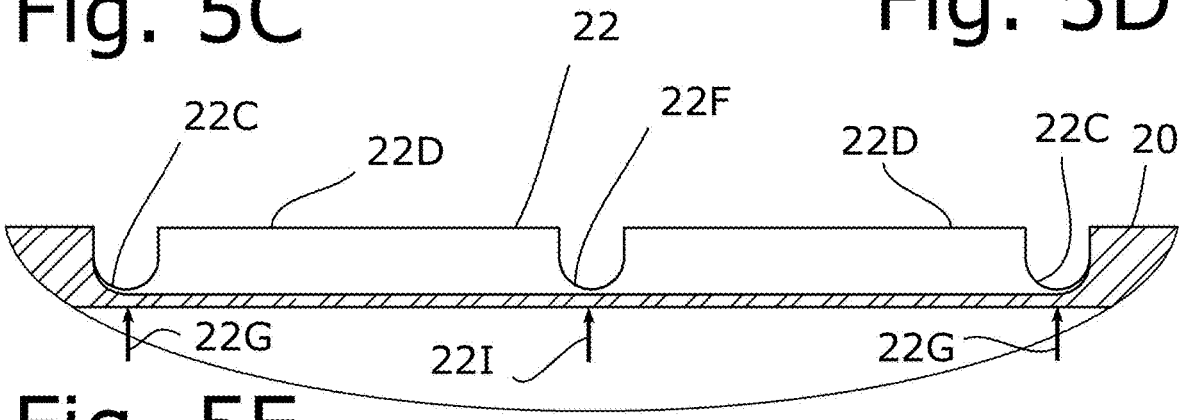
FIG. 5E is an expanded view of the detail C in FIG. 5C.
Figure 5F:
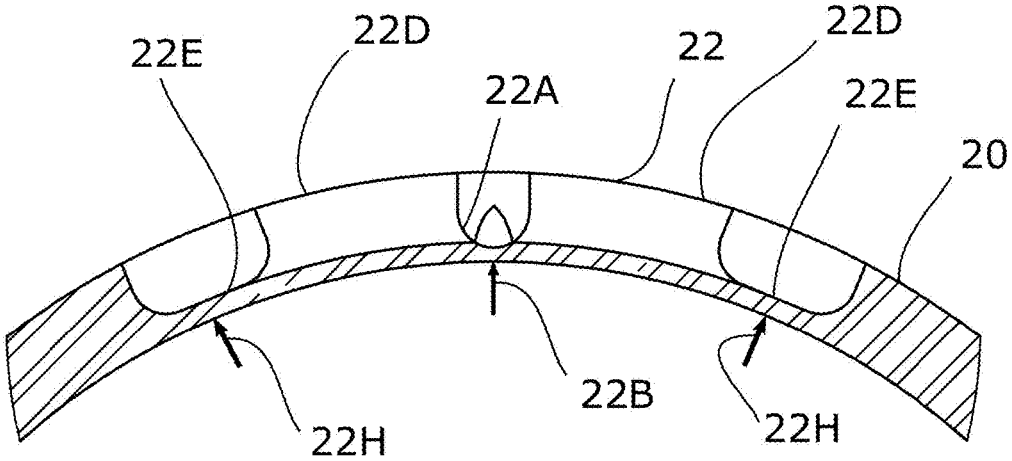
FIG. 5F is an expanded view of the detail D in FIG. 5D.
Figure 5G:
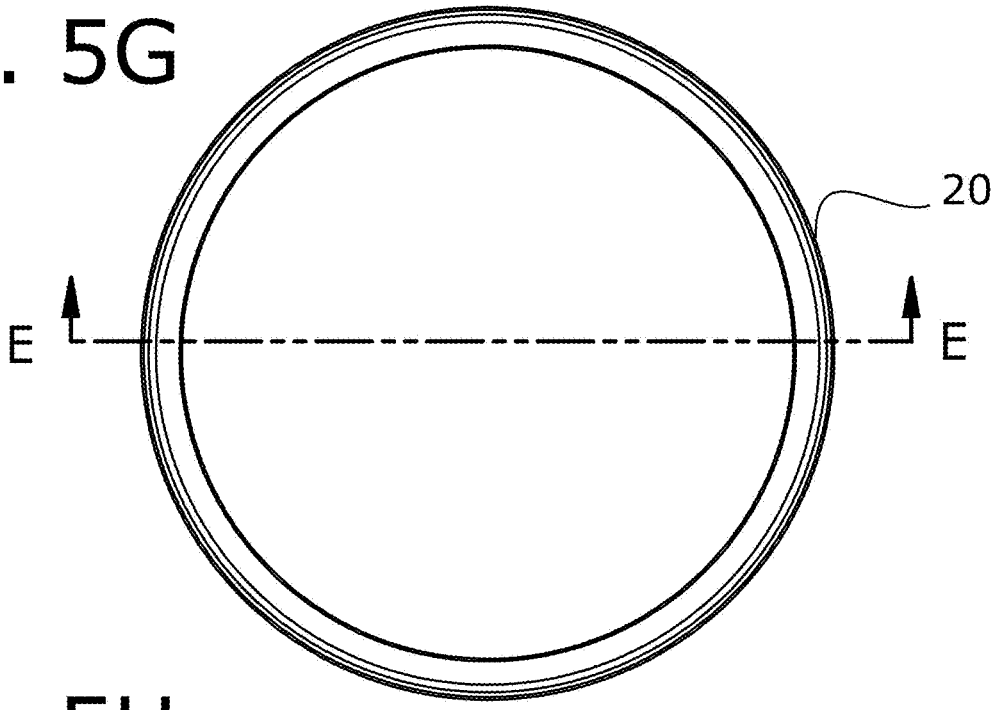
FIG. 5G is a front view of the sleeve according to FIG. 5A.
Figure 5H:
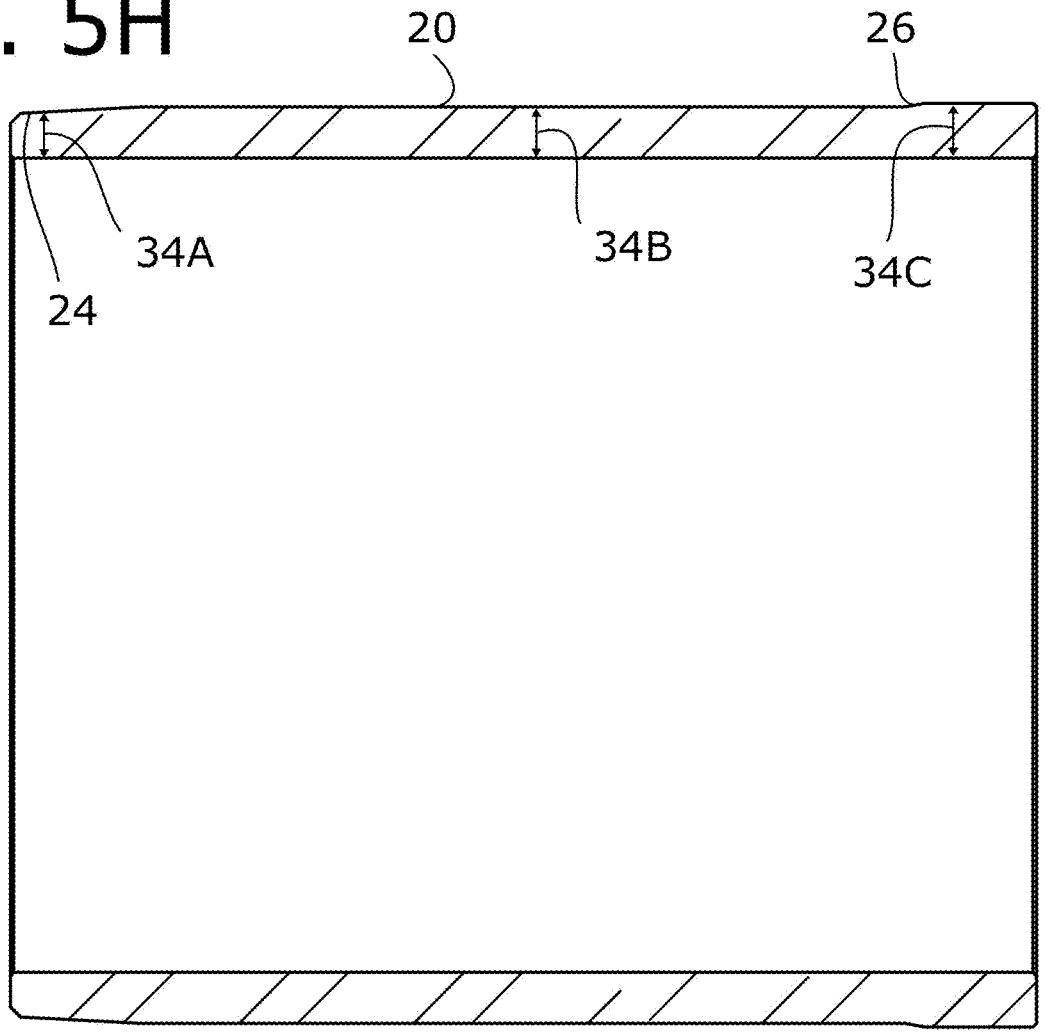
FIG. 5H is a cross-section view taken through the section E-E in FIG. 5G.

To use a tubing drain 10, an annular body 12 is provided and a sleeve 20 is inserted into one end of the annular body 12. The sleeve 20 may be press fit into the annular body 12. Exterior portions of sleeve 20 and interior portions of annular body 12 may have sections with different diameters which contact respective surfaces of the other of sleeve 20 and annular body 12 when sleeve 20 is inserted into annular body 12. Sections with different diameters may comprise structures such as shoulders and tapered faces. Examples includes shoulder 126 shown in FIG. 4G and tapered faces 24 and 26 of sleeve 20. As shown in FIG. 5H, tapered faces 24 and 26 in sleeve 20 provide different diameters 34A, 34B, 34C over the length of the sleeve.

In various embodiments, the sleeve 20 may be shrink fit (using heat or cooling) into the annular body and axial compression may be applied to improve sealing with compression provided by an adjacent tubing section 40 pressing the sleeve 20 into a shoulder, such as shoulder 126, in annular body 12. During the insertion of sleeve 20 in annular body 12, burst profile 22 is aligned with a window 14 in annular body 12. Alignment of burst profile 22 may comprise a partial or full overlap between the burst profile 22 and window 14.

Once sleeve 20 is inserted in annular body 12, the tubing drain 10 is installed in the tubing string. During operations of the hydrocarbon well, a pressure differential may arise between the interior and exterior of the tubing string, i.e. as between the interior of the tubing string and the space between the casing and the tubing string exterior. This pressure differential may be triggered by an intentional pressure increase produced at the surface. The burst profile 22 of sleeve 20 may rupture when a targeted pressure differential is reached. The burst profile 22 may burst along the milled cavities, allowing draining of fluids from the high pressure region to the low pressure region. Typically, this would result in draining of fluids from the interior of the tubing string into the casing.

At some point after the pressure differential has been resolved, the tubing string may be tripped out of the well. It may be easier and environmentally more friendly to trip drained tubing out of the well. The sleeve 20 of tubing drain 10 may be pressed out of the annular body 12 and discarded or recycled. If annular body 12 has suffered damage, repairs may be made to the annular body 12 and it may then be reused. A new sleeve 20 may be provided and inserted into annular body 12 to be used again in the tubing string.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A tubing drain comprising:

an annular body defining a bore and defining a window through the annular body between an exterior of the annular body and the bore, the annular body comprising first and second connector ends, each connector end connectable to a respective tubing section in a tubing string; and an inner body insertable into the bore of the annular body, the inner body comprising a sleeve, the inner body being configured to rupture when exposed to a target condition.

2. The tubing drain according to claim 1, the inner body comprising a burst profile and at least a portion of the burst profile aligns with the window of the annular body.

3. The tubing drain according to claim 2, the target condition comprising a pressure differential across the burst profile.

4. The tubing drain according to claim 2, wherein the burst profile comprises one or more cavities in the inner body.

5. The tubing drain according to claim 4 wherein the one or more cavities comprises a central groove and the burst profile comprises two or more burst profile flaps, at least one burst profile flap positioned on each side of the central groove.

6. The tubing drain according to claim 5 wherein the burst profile flaps are configured to burst open to a radius less than or equal to a maximum radius of the annular body.

7. The tubing drain according to claim 1, the inner body being fastenable into the bore of the annular body under compressive stress.

8. The tubing drain of claim 7, the inner body being fastenable into the bore of the annular body by an interference fit between the inner body and at least a portion of the bore.

9. The tubing drain of claim 8 wherein the interference fit between the inner body and the annular body provides a seal substantially preventing fluid flow between the bore and the window of the annular body.

10. The tubing drain according to claim 7, the inner body being fastenable into the bore of the annular body by compression between two or more axially separated components in the tubing string.

11. The tubing drain according to claim 10, wherein two of the axially separated components in the tubing string comprise the respective tubing sections.

12. The tubing drain according to claim 10, wherein two of the axially separated components in the tubing string comprise one of the respective tubing sections and a structure in the bore of the annular body.

13. The tubing drain according to claim 12, wherein the structure in the bore of the annular body comprises a shoulder in the bore defined by a reduced internal diameter.

14. The tubing drain according to claim 1, wherein the inner body being fastenable into the bore of the annular body by compression between a first axially separated components and a second axially separated component in the tubing string, and wherein the annular body comprises:

a first body portion, the first axially separated component comprising a stop in the first body portion; and a second body portion, the second axially separated component comprising a stop in the second body portion, the second body portion threadable onto the first body portion to fasten the inner body between the first body portion and the second body portion.

15. The tubing drain according to claim 1, in which the inner body has an outer diameter over at least a portion of its length greater than an inner diameter of the respective tubing sections connectable to the first and second connector ends.

16. The tubing drain according to claim 1 wherein the inner body comprises:

a central inner body portion with a central inner body portion diameter; and a first inner body portion at a first end of the inner body with a larger exterior diameter than the central inner body portion diameter.

17. The tubing drain according to claim 16 wherein the inner body comprises a second inner body portion at a second end of the inner body with a smaller exterior diameter than the central inner body portion diameter.

18. The tubing drain according to claim 1, wherein the inner body is held in place inside the bore of the annular body by a compressive load, the compressive load being an axial load, a hoop load, or both an axial load and a hoop load.

19. The tubing drain according to claim 2, wherein the inner body is rotated axially inside of the bore of the annular body to at least partially align the burst profile with the window of the annular body.

20. A tubing drain comprising:

an annular body defining a bore and defining a window through the annular body between an exterior of the annular body and the bore, the annular body comprising first and second connector ends, each connector end connectable to a respective tubing section in a tubing string; and an inner body insertable into the bore of the annular body, the inner body being configured to rupture when exposed to a target condition, the inner body comprising a burst profile and at least a portion of the burst profile aligns with the window of the annular body, wherein the burst profile comprises one or more cavities in the inner body, wherein the one or more cavities comprises a central groove and the burst profile comprises two or more burst profile flaps, at least one burst profile flap positioned on each side of the central groove, and wherein the central groove is oriented parallel to an axis of the tubing drain.

21. A tubing drain comprising:

a first annular body portion;

a second annular body portion, the first annular body portion and the second annular body portion fastened together by threads located on an end of the first annular body portion and threads located on an end of the second annular body portion; and a sleeve insertable into the second annular body portion of the tubing drain, the sleeve configured to rupture when exposed to a targeted pressure differential.

* * * * *